US009104171B2

(12) United States Patent
Azeyanagi et al.

(10) Patent No.: US 9,104,171 B2
(45) Date of Patent: Aug. 11, 2015

(54) DETACHABLE UNIT AND IMAGE FORMING APPARATUS INCORPORATING SAME

(71) Applicants: Yuta Azeyanagi, Kanagawa (JP); Hiromichi Ninomiya, Kanagawa (JP); Satoshi Hatori, Kanagawa (JP); Naohiro Kumagai, Kanagawa (JP); Nobuyuki Taguchi, Kanagawa (JP); Kaoru Yoshino, Tokyo (JP); Yasuhito Kuboshima, Tokyo (JP); Hideyasu Seki, Chiba (JP); Ryohta Gotoh, Tokyo (JP)

(72) Inventors: Yuta Azeyanagi, Kanagawa (JP); Hiromichi Ninomiya, Kanagawa (JP); Satoshi Hatori, Kanagawa (JP); Naohiro Kumagai, Kanagawa (JP); Nobuyuki Taguchi, Kanagawa (JP); Kaoru Yoshino, Tokyo (JP); Yasuhito Kuboshima, Tokyo (JP); Hideyasu Seki, Chiba (JP); Ryohta Gotoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/150,113

(22) Filed: Jan. 8, 2014

(65) Prior Publication Data

US 2014/0199091 A1 Jul. 17, 2014

(30) Foreign Application Priority Data

Jan. 16, 2013 (JP) ..... 2013-005783
Jan. 16, 2013 (JP) ..... 2013-005785

(51) Int. Cl.
*G03G 21/18* (2006.01)
*G03G 21/20* (2006.01)
*G03G 21/16* (2006.01)

(52) U.S. Cl.
CPC ..... *G03G 21/1647* (2013.01); *G03G 21/1814* (2013.01); *G03G 21/206* (2013.01)

(58) Field of Classification Search
CPC ..... G03G 21/206; G03G 2221/1645; G03G 21/185
USPC ..... 399/92
See application file for complete search history.

(56) References Cited

U.S. PATENT DOCUMENTS

| | | | | |
|---|---|---|---|---|
| 5,081,496 | A * | 1/1992 | Takeda | 399/92 |
| 7,877,037 | B2 * | 1/2011 | Igarashi | 399/92 |
| 7,941,069 | B2 * | 5/2011 | Idehara et al. | 399/92 |
| 8,150,292 | B2 * | 4/2012 | Ohashi | 399/92 |
| 8,660,466 | B2 * | 2/2014 | Mihara et al. | 399/254 |
| 2003/0185585 | A1 | 10/2003 | Kimura et al. | |
| 2007/0002122 | A1 | 1/2007 | Murano et al. | |
| 2007/0071525 | A1 | 3/2007 | Yoshino et al. | |
| 2009/0142115 | A1 | 6/2009 | Muraishi et al. | |

(Continued)

FOREIGN PATENT DOCUMENTS

| | | |
|---|---|---|
| JP | 2007-041494 | 2/2007 |
| JP | 2007-219398 | 8/2007 |
| JP | 2012-003058 | 1/2012 |

(Continued)

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

A detachable device, which can be included in an image forming apparatus, includes a unit drive mechanism, and a cover disposed at one end and an opposite end in the given attachment/detachment direction to cover the unit drive mechanism thereof. The cover includes a first cover and a second cover. The first cover includes at least one first inlet port to intake air from the apparatus body and guide the air to the detachable unit. The second cover includes a second inlet port to intake the air guided into the detachable unit and an air outlet port to exhaust the air introduced from the second inlet port to the apparatus body.

17 Claims, 20 Drawing Sheets

(56) References Cited

U.S. PATENT DOCUMENTS

2011/0274447 A1 11/2011 Arai et al.
2011/0311261 A1* 12/2011 Yamashita et al. ..... 399/92

FOREIGN PATENT DOCUMENTS

JP 2012-003059 1/2012
JP 2013-114127 A * 6/2013

* cited by examiner

DETACHABLE UNIT AND IMAGE FORMING APPARATUS INCORPORATING SAME

CROSS-REFERENCE TO RE APPLICATIONS

This patent application is based on and claims priority pursuant to 35 U.S.C. §119 to Japanese Patent Application Nos. 2013-005783, filed on Jan. 16, 2013 and 2013-005785, filed on Jan. 16, 2013 in the Japan Patent Office, the entire disclosures of which are hereby incorporated by reference herein.

BACKGROUND

1. Technical Field

Embodiments of the present invention relate to a detachable unit that is detachably attached to a body of an image forming apparatus, and the image forming apparatus including the detachable unit.

2. Related Art

These days, users and customers demand a more reduction in size of image forming apparatuses and a higher speed in image processing. In response to these demands, image forming units disposed around a photoconductor are driven at a higher speed. For example, a development device (such as a process cartridge or a development unit) that is detachably attached to an apparatus body of an image forming apparatus includes developer therein. Due to an increase in speed of agitating the developer, an increase in temperature in the process cartridge and/or the development unit tends to be significant. A temperature increase in the process cartridge and/or the development unit repeats melting and coagulation of toner contained in the developer, which is likely to cause image defect such as development failure and white streaks.

To avoid these problems, a drive mechanism of the detachable unit that includes the process cartridge and/or the development unit needs to be cooled. The drive mechanism of the development device is detachably connected via various joints such as couplings with a drive mechanism of the apparatus body of the image forming apparatus that is disposed on a rear side of the apparatus body.

Some techniques for cooling a development device are disclosed in Japanese Patent Application Publication Nos. JP 2007-219398-A and JP 2012-003059-A, for example, by blowing along an outer surface of a cover of the development device or by introducing and discharging air in a container box that is provided at one end side of the development device.

JP 2007-219398-A has a configuration that includes a fan to supply air for cooling the development device by airflow. A direction of airflow generated by the fan is set to be parallel to a direction in which a supply pipe is connected or disconnected.

JP 2012-003059-A has a configuration that includes a container box having an agitation gear that rotates an agitating member agitating the developer and a development gear that rotates a developing member supplying the developer to an image carrier. The container box includes a fan that has an air inlet and an air outlet.

SUMMARY

At least one embodiment of the present invention provides a detachable unit detachably attached to an image forming apparatus in a given attachment/detachment direction and including a unit body, a unit drive mechanism included in the unit body, and a cover. The unit drive mechanism serves as a heater to be cooled. The cover is disposed at one end and an opposite end of the unit body in the given attachment/detachment direction to cover the unit drive mechanism. The cover includes a first cover and a second cover. The first cover includes at least one first inlet port to intake air from the apparatus body and guide the air to the unit body. The second cover includes a second inlet port to intake the air guided into the unit body and an air outlet port to exhaust the air introduced from the second inlet port to the apparatus body.

Further, at least one embodiment of the present invention provides an image forming apparatus including an apparatus body, an image forming unit included in the apparatus body to form an image, and the above-described detachable unit.

Further, at least one embodiment of the present invention provides a detachable unit detachably attached to an image forming apparatus in a given attachment/detachment direction and including a unit body, a unit drive mechanism included in the unit body, and a cover. The unit drive mechanism serves as a heater to be cooled and has a rotary body. The unit drive mechanism includes a first unit drive mechanism and a second unit drive mechanism. The first unit drive mechanism is disposed at one end of the unit body in a given attachment/detachment direction and connected to an apparatus drive mechanism provided to an apparatus body. The second unit drive mechanism is disposed at the one end of the unit body in the given attachment/detachment direction to transmit a driving force to the first unit drive mechanism and to drive a rotary body of the unit drive mechanism. The cover is disposed at the one end of the unit body in the given attachment/detachment direction to cover the second unit drive mechanism while exposing the first unit drive mechanism. The cover defines an airflow path that passes through the second unit drive mechanism.

Further, at least one embodiment of the present invention provides an image forming apparatus including an apparatus body, an image forming unit included in the apparatus body to form an image, and the above-described detachable unit.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
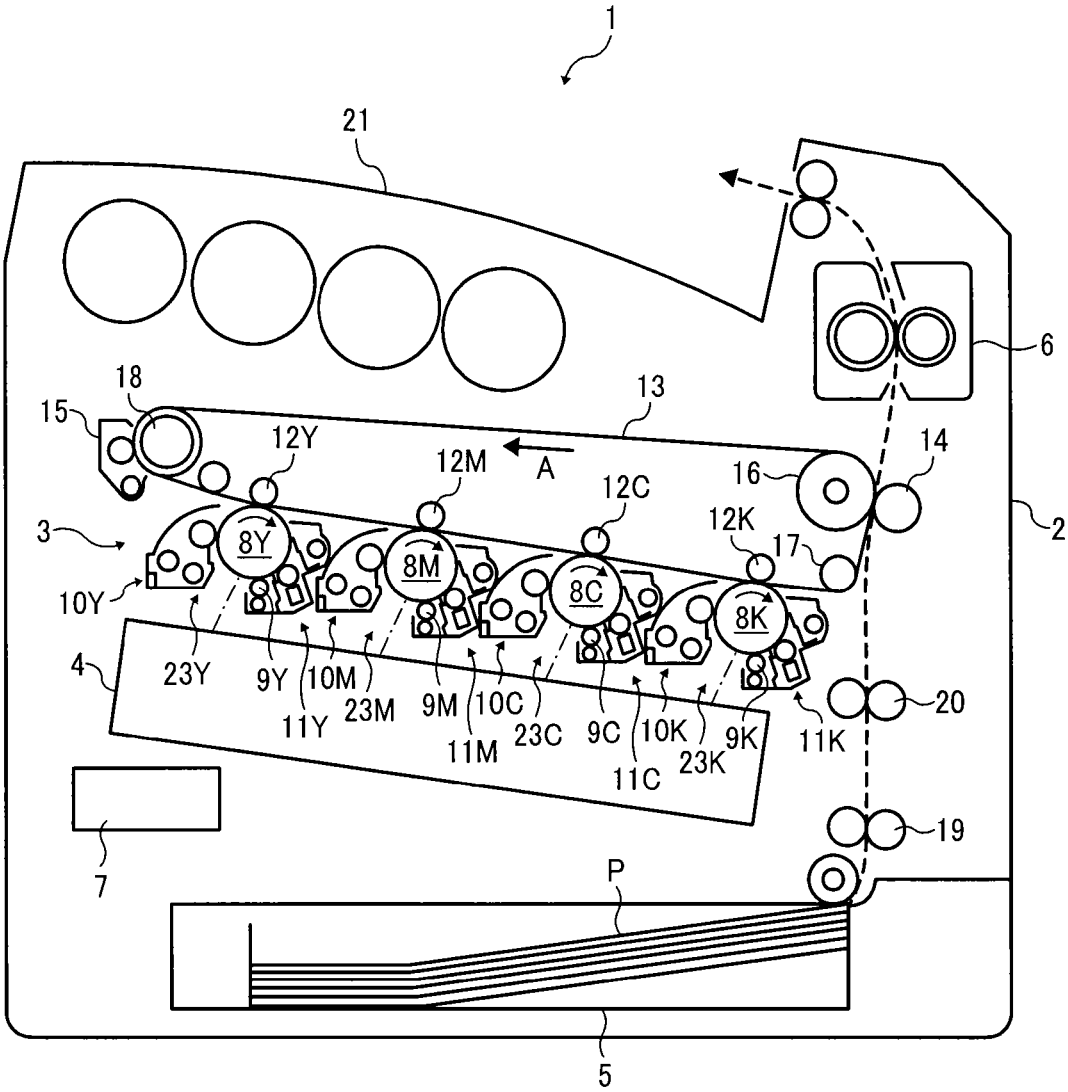
FIG. 1 is a schematic diagram illustrating an image forming apparatus according to Embodiment 1 of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
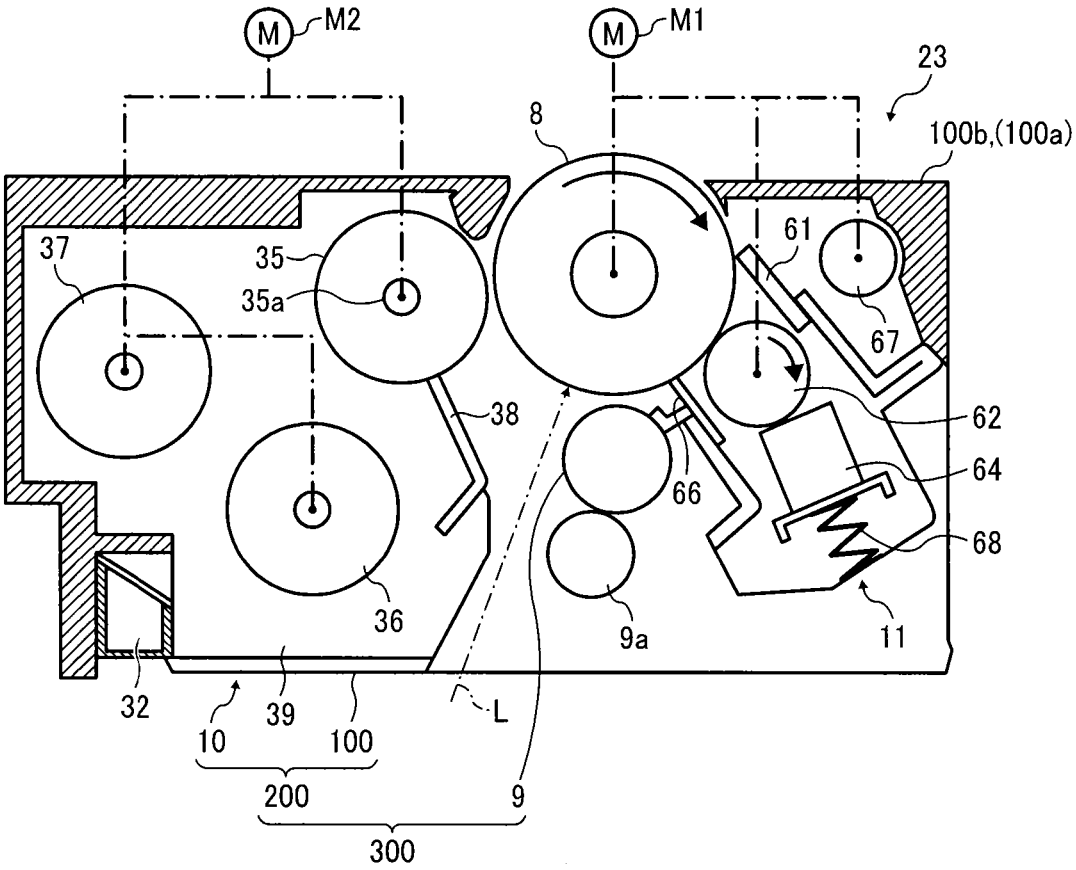
FIG. 2 is a cross-sectional schematic view illustrating one of four image forming units (a process cartridge) along a line of S5-S5 of FIG. 5.

A description is given of an image forming apparatus 1 according to an embodiment of the present invention, with reference to FIGS. 1 and 2.

FIG. 1 is a vertical cross sectional view illustrating a schematic configuration of an image forming apparatus 1000 according to an embodiment of the present invention. The image forming apparatus 1000 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1000 is an electrophotographic color printer that forms color and monochrome toner images on recording media by electrophotography.

FIG. 1 illustrates a schematic configuration of the image forming apparatus 1 according to an embodiment of the present invention. The image forming apparatus 1 is a tandem-type image forming apparatus with a non-contact transfer system.

As illustrated in FIG. 1, the image forming apparatus 1 has an apparatus body 2 that includes an image forming part 3, an optical writing unit 4, a sheet tray 5, a fixing device 6, and a waste toner collecting container 7. The apparatus body 2 includes the framework or frame of housing or casing provided in the image forming apparatus 1.

The image forming part 3 is also referred to as a printer engine in which a toner image is formed on an image carrier and transferred onto a recording medium.

The optical writing unit 4 emits a light beam toward the image carrier included in the image forming part 3.

The sheet tray 5 accommodates recording media including a sheet-like recording medium P that functions as an image transfer target.

The fixing device 6 fixes the toner image to the recording medium P.

The waste toner collecting container 7 collects and stores waste toner remaining on the image carrier after transfer of the toner image.

The image forming part 3 includes four image forming units 23Y, 23M, 23C, and 23K corresponding to yellow (Y), magenta (M), cyan (C), and black (K) toners, respectively. The image forming units 23Y, 23M, 23C, and 23K are disposed from left to right of FIG. 1 in this order. The image forming part 3 further includes primary transfer rollers 12Y, 12M, 12C, and 12K disposed corresponding to the image forming units 23Y, 23M, 23C, and 23K, an intermediate transfer belt 13 that functions as an intermediate transfer member, and a secondary transfer roller 14.

The image forming units 23Y, 23M, 23C, and 23K employ different single color toners, which are yellow (Y), magenta (M), cyan (C), and black (K) toners. Except for the colors of toners, the image forming units 23Y, 23M, 23C, and 23K have configurations identical to each other. Hereinafter, the units and components included in the apparatus body 2 of the image forming apparatus 1 are often referred to in a singular unit without suffix indicating toner colors, Y, M, C, and K. For example, the image forming units 23Y, 23M, 23C, and 23K may also be referred to as "the image forming unit 23".

FIG. 2 is a cross-sectional schematic view illustrating one of the image forming units 23Y, 23M, 23C, and 23K. FIG. 2 is sectioned along a line of S5-S5 of FIG. 5, which is described below.

As illustrated in FIG. 2, the image forming unit 23 of FIG. 2 includes a configuration and functions as a detachable unit and a process unit according to the present embodiment and is detachably attached to the apparatus body 2.

As illustrated in FIG. 2, the image forming unit 23 has a unit body 100 that includes a photoconductor 8 that functions as an image carrier, a charging roller 9 that functions as a charger, a development device 10, and a photoconductor cleaning device 11 that functions as a cleaning device. It is to be noted that the unit body 100 functions as a unit apparatus body of the image forming unit 23 and includes the framework or frame of the unit apparatus body.

By assembling the photoconductor 8, the charging roller 9, the development device 10, and the photoconductor cleaning device 11 in the process cartridge, replacement and safety maintenance service can be easier and accuracy in positions of the components can be maintained. Therefore, image quality can be enhanced.

In this embodiment, the image forming unit 23 functioning as a process cartridge can be replaced as a whole. However, any other configurations of the process cartridge are also applicable. For example, the image forming unit 23 as a process cartridge in which the photoconductor 8 and at least one of the charging roller 9, the development device 10, and the photoconductor cleaning device 11 are included in the unit body 100 can be applied to the present invention. Alternatively, the image forming unit 23 that functions as a process cartridge can be detached form the apparatus body 2 and each image forming components such as the photoconductor 8, the charging roller 9, the development device 10, and the photoconductor cleaning device 11 can be replaced as a unit.

With reference to FIGS. 1 and 2, a description is given of the detailed configuration of the image forming apparatus 1 and image forming operations performed therein.

The photoconductor 8 has a cylindrical shape and is linked to a single photoconductor drive motor M1 that functions as a drive source of the photoconductor 8 via a drive transmission unit having a gear train, which will be described below. The photoconductor 8 rotates about a central axis thereof by the driving force applied by the photoconductor drive motor M1. The photoconductor 8 has an outer circumferential surface on which a photoconductive layer is provided to form an electrostatic latent image.

The charging roller 9 is disposed not in contact with but adjacent to the outer circumferential surface of the photoconductor 8. A power source applies a voltage to the charging roller 9, so that the outer circumferential surface of the photoconductor 8 is uniformly charged. The charging roller 9 includes a charger cleaning roller 9*a*.

It is to be noted that the power source to drive the photoconductor 8 is not limited to the photoconductor drive motor M1. For example, the photoconductor 8K and the intermediate transfer belt 13 can be driven by a common drive motor and the photoconductors 8Y, 8M, and 8C can be driven by another common drive motor.

The optical writing unit 4 emits a light beam based on image data transmitted by a controller to irradiate the outer circumferential surface of the photoconductor 8. This irradiation forms an electrostatic latent image according to image data on the outer circumferential surface of the photoconductor 8.

The development device 10 supplies toner as developer to the photoconductor 8. The toner supplied to the photoconductor 8 is attached to the electrostatic latent image formed on the outer circumferential surface of the photoconductor 8, so that the electrostatic latent image on the outer circumferential surface of the photoconductor 8 is developed into a visible toner image. It is to be noted that a two-component developer that includes toner and carriers is used in the present embodiment but the developer is not limited thereto. For example, a one-component developer that includes toner without carrier is also applicable to the present invention.

The intermediate transfer belt 13 is an endless loop formed with a resin film body or a rubber body and is wound about a drive roller 16, an entrance roller 17, and a tension roller 18 in a loop. As the drive roller 16 that is connected to a drive motor rotates, the intermediate transfer belt 13 rotates in a direction indicated by arrow A in FIG. 1. As the intermediate transfer belt 13 rotates in the direction A, the entrance roller 17 and the tension roller 18 are rotated by a friction force exerted by friction with the intermediate transfer belt 13.

The primary transfer rollers 12Y, 12M, 12C, and 12K are disposed in contact with an inner circumferential surface of the intermediate transfer belt 13 (inside the loop). A transfer bias (a primary transfer bias) is applied to the primary transfer rollers 12Y, 12M, 12C, and 12, so that respective toner images formed on the photoconductors 8Y, 8M, 8C, and 8K are transferred onto the intermediate transfer belt 13. The toner images formed on the photoconductors 8Y, 8M, 8C, and 8K are sequentially transferred onto the intermediate transfer belt 13 to be overlaid to form a color toner image on the intermediate transfer belt 13.

When the recording medium P is conveyed to a transfer position where the intermediate transfer belt 13 and the secondary transfer roller 14 contact with each other, the transfer voltage is applied to the secondary transfer roller 14. At this time, the color toner image formed on the intermediate transfer belt 13 is conveyed to the transfer position and the color toner image is transferred onto the recording medium P.

The recording medium P is fed from the sheet tray 5 and conveyed by a conveyance roller pair 19 and a registration roller pair 20. After the toner image is transferred onto the recording medium P, the recording medium P is conveyed to the fixing device 6. The fixing device 6 applies heat and pressure to the recording medium P, so that the melt toner image is fixed to the recording medium P.

The recording medium P to which the toner image is fixed in the fixing device 6 is further conveyed by a sheet discharging roller pair and is discharged onto a sheet discharging tray 21 that is formed on top of the apparatus body 2.

The photoconductor cleaning device 11 cleans the outer circumferential surface of the photoconductor 8 after the toner image is transferred onto the intermediate transfer belt 13. With this cleaning operation performed after the toner image is transferred onto the intermediate transfer belt 13, residual toner and dust remaining on the outer circumferential surface of the photoconductors 8Y, 8M, 8C, and 8K are collected as waste toner.

Further, the photoconductor cleaning device 11 includes a lubricant application unit to apply lubricant on the outer circumferential surface of the photoconductors 8Y, 8M, 8C, and 8K after the cleaning operation.

The photoconductor cleaning device 11 includes a cleaning blade 61, an application roller 62, and a regulating roller 66 in the order from an upstream side in a rotation direction of the photoconductor 8 as indicated by arrow in FIG. 2.

The photoconductor cleaning device 11 removes residual toner by the cleaning blade 61. The cleaning blade 61 is fixed to a holder and is disposed in contact in a counter direction with the outer circumferential surface of the photoconductor 8 with respect to a surface moving direction of the photoconductor 8. The cleaning blade 61 is disposed in contact with the photoconductor 8 with pressure applied by a pressure spring, so as to remove toner.

The lubricant application unit includes the application roller 62, a solid lubricant 64, a solid lubricant holder, and a lubricant pressing spring 68. The solid lubricant 64 is held by the solid lubricant holder. In the lubricant application unit, the application roller 62 and the solid lubricant 64 are pressed by the lubricant pressing spring 68.

FIG. 2 is viewed from the front side of the unit body 100. As illustrated in FIG. 2, the unit body 100 has a unit front end 100*a* and a unit rear end 100*b*. The unit front end 100*a* is disposed at the front side of the unit body 100 and includes a unit front side panel. The unit rear end 100*b* is disposed at the rear side of the unit body 100 and includes a unit rear side panel.

The application roller 62 is rotatably supported by the unit front end 100*a* and the unit rear end 100*b* via a shaft thereof. The application roller 62 has a rotary body that contacts the outer circumferential surface of the photoconductor 8 and an outer circumferential surface thereof is formed by sponge that is an elastic material. With this configuration, the application roller 62 applies lubricant scraped from the solid lubricant 64 to the outer circumferential surface of the photoconductor 8. The application roller 62 is arranged to rotate in a counter direction with respect to the surface moving direction of the photoconductor 8.

It is to be noted that the unit rear end 100*b* corresponds to one end side and one end portion of the image forming unit 23 that serves as a detachable unit according to an embodiment.

An intermediate transfer belt cleaning device 15 is provided to clean the outer circumferential surface of the intermediate transfer belt 13 after the color toner image is transferred onto the recording medium P. According to this cleaning operation, residual toner and paper dust remaining on the outer circumferential surface of the intermediate transfer belt 13 are collected after transfer of the color toner image.

The waste toner collecting container 7 stores waste toner collected from the photoconductor cleaning device 11 and the intermediate transfer belt cleaning device 15. The waste toner collecting container 7 is detachably attached with respect to the apparatus body 2. When the waste toner stored in the waste toner collecting container 7 approaches to a full state, the waste toner collecting container 7 with nearly full of waste toner is removed from the apparatus body 2 to be replaced with an empty waste toner collecting container 7.

Next, a detailed description is given of the configuration of the image forming unit 23 with reference to FIG. 2.

The image forming unit 23 includes the photoconductor 8 that functions as an image carrier or a latent image carrier and the charging roller 9 that charges the surface of the photoconductor 8. Further the image forming unit 23 includes the development device 10. After a laser light beam L the image forming unit 23 has been emitted from the optical writing unit 4 to irradiate the surface of the photoconductor 8 charged by the charging roller 9, the development device 10 supplies toner to the electrostatic latent image formed on the surface of the photoconductor 8 to develop the electrostatic latent image to a visible toner image.

After the toner image formed at the primary transfer part has been transferred onto the intermediate transfer belt 13, the cleaning blade 61 removes residual toner remaining on the surface of the photoconductor 8. The toner removed by the cleaning blade 61 is conveyed to an outside of the photoconductor cleaning device 11 by a conveyance screw 67.

After residual toner has been removed by the cleaning blade 61, the application roller 62 that contacts the outer circumferential surface of the photoconductor 8 applies lubricant on the outer circumferential surface of the photoconductor 8. The lubricant used in the present embodiment is made by mixing zinc stearate, boron nitride, and alumina and solidifying the mixture due to compression molding to form a solid lubricant 64. The lubricant is supplied to the outer circumferential surface of the photoconductor 8 by rotating the application roller 62 in the counter direction with respect to the rotation direction of the photoconductor 8 with the solid lubricant 64 pressed against the application roller 62 by the lubricant pressing spring 68, and by scraping the solid lubricant 64 to apply the lubricant on the outer circumferential surface of the photoconductor 8.

It is to be noted that the application roller 62 can be configured to rotate in a trailing direction with respect to the rotation direction of the photoconductor 8.

The powder lubricant is scraped from the solid lubricant 64 and applied onto the surface of the photoconductor 8 by the application roller 62. The powder lubricant is then regulated by the regulating roller 66 on the surface of the photoconductor 8. The regulating roller 66 is a fixed pressure type member that is supported in contact with the surface of the photoconductor 8.

After the residual toner is removed from the surface of the photoconductor 8 as described above, the image forming unit 23 is applied with the lubricant, so as to be ready for the next image forming operations, starting from a uniform charging operation performed by the charging roller 9.

The application roller 62 and the conveyance screw 67 are linked to the photoconductor drive motor M1 that functions as a drive source driving the photoconductor 8 via the drive transmission unit having the gear train. As the photoconductor drive motor M1 rotates, the application roller 62 and the conveyance screw 67 are rotated.

The development device 10 includes a development roller 35, a first agitation conveyance screw 36, a second agitation conveyance screw 37, and a doctor blade 38. The development roller 35 functions as a developer bearing member that carries developer to be supplied to the photoconductor 8. The first agitation conveyance screw 36 and the second agitation conveyance screw 37 function as rotary members to agitate and convey the developer. The doctor blade 38 functions as a developer layer thickness regulating member. The development roller 35 is rotatably provided via a development roller shaft 35*a* that is supported by a development device case 39 that serves as a casing of the development device 10. The development roller shaft 35*a* functions as a developer bearing member shaft and includes a conductive member formed by stainless steel, for example. The development roller shaft 35*a* is applied with a development bias voltage.

The development roller 35, the first agitation conveyance screw 36, and the second agitation conveyance screw 37 are linked to a development drive motor M2 that functions as a developer bearing member drive unit via drive transmission unit that includes a gear train, which will be described below. As the development drive motor M2 rotates, the development roller 35, the first agitation conveyance screw 36, and the second agitation conveyance screw 37 are rotated.

Figure 3:
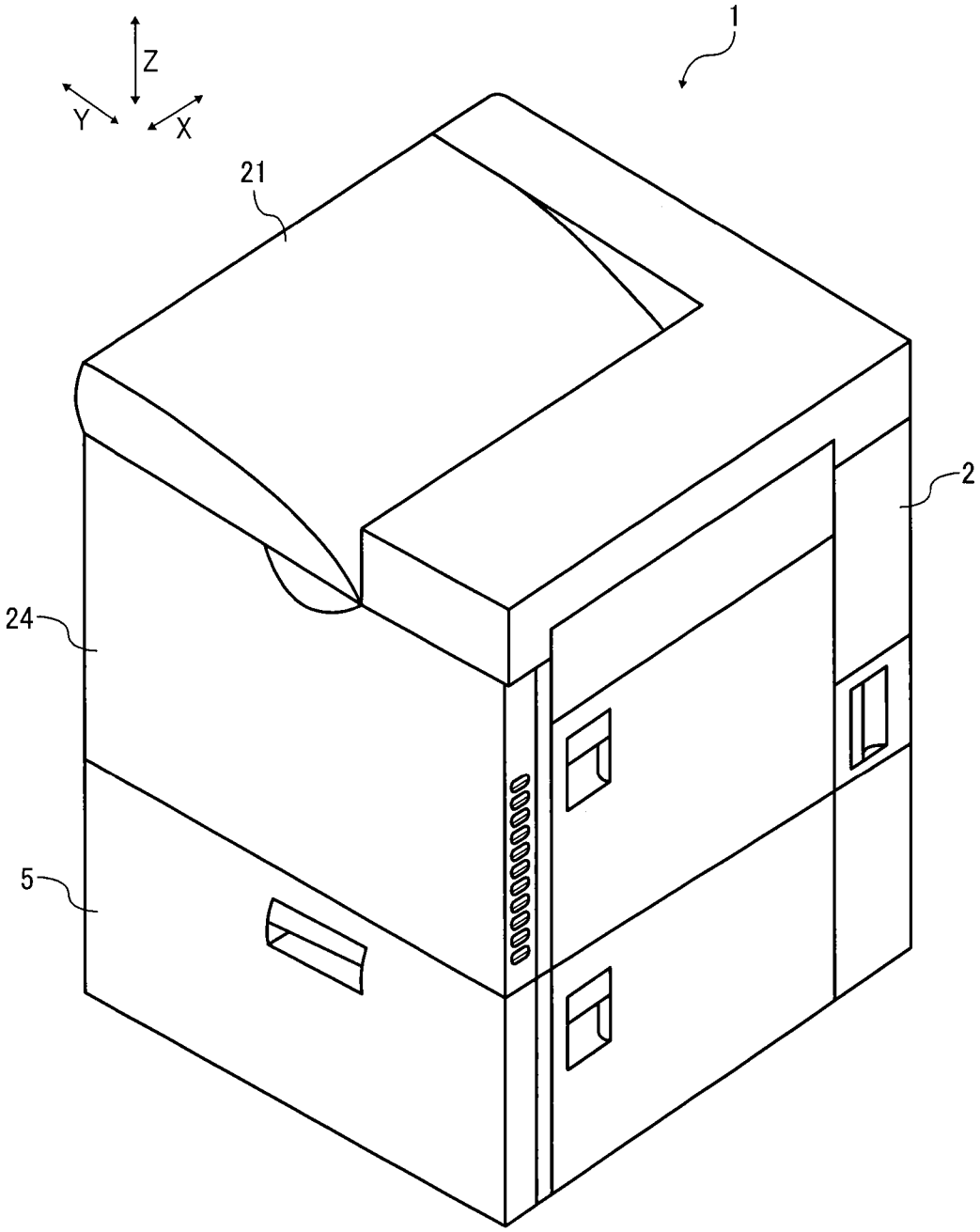
FIG. 3 is a perspective view illustrating an external appearance of the image forming apparatus with a front cover of an apparatus body case open.
Figure 4:
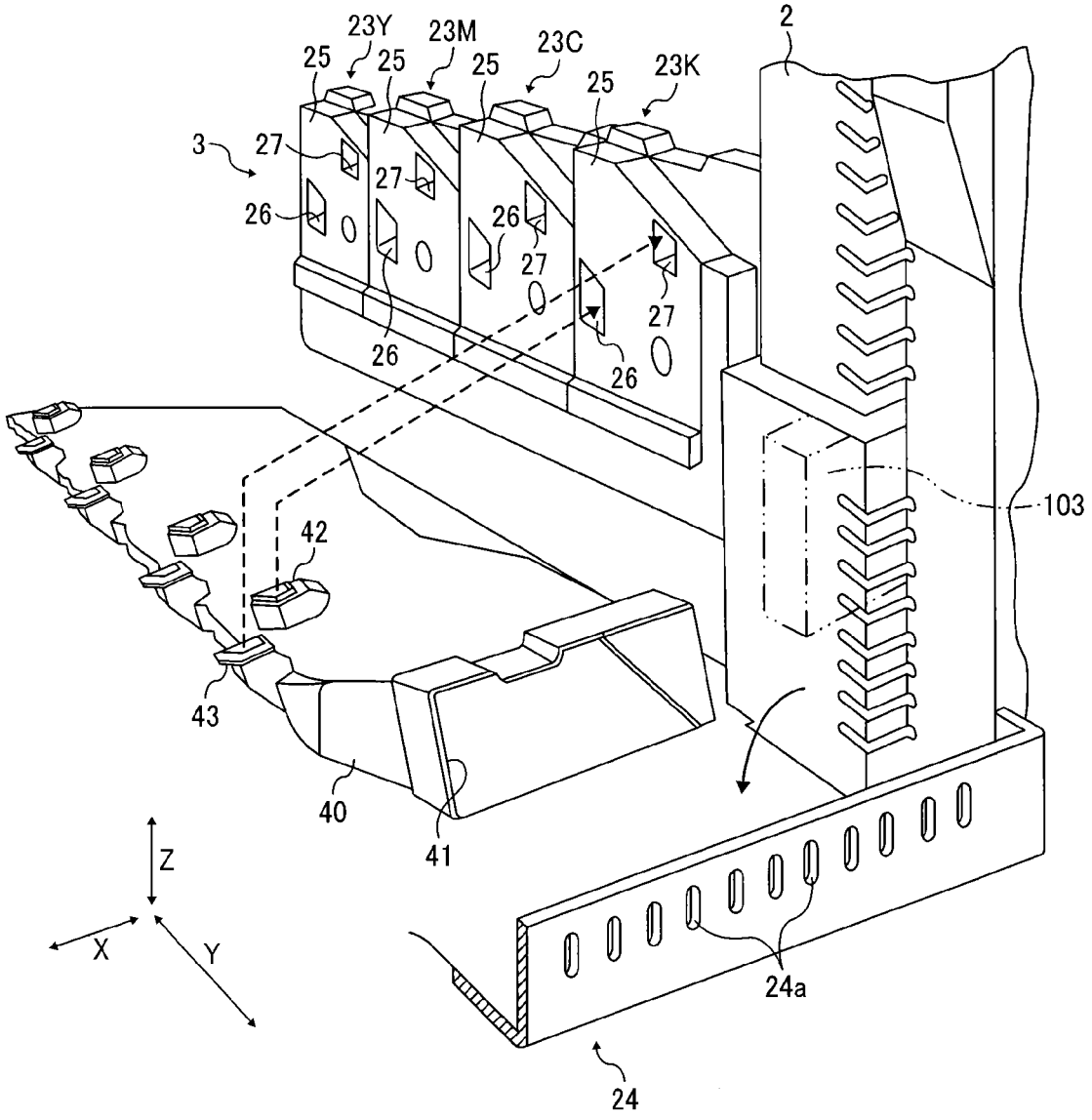
FIG. 4 is a perspective view illustrating a positional relation of each image forming unit and a branch duct with the front cover of the apparatus body case open.

FIG. 3 is a perspective view illustrating the image forming apparatus 1 in a state in which an apparatus front cover 24 is closed. The apparatus front cover 24 functions as an open/close member that opens or closes with respect to a front surface of the apparatus body 2. FIG. 4 is a perspective view illustrating a main part of the image forming apparatus 1 to show a positional relation of the image forming units 23K, 23M, 23C, and 23K and a branch duct 40 in a state in which the apparatus front cover 24 is open.

As indicated in FIGS. 3 and 4, a direction X corresponds to a front-to-back direction of the image forming apparatus 1, a direction Y corresponds to a left-to-right direction (and a lateral direction indicating a width) which is perpendicular to the direction X, and a direction Z corresponds to a vertical direction (and a direction indicating a height) which is perpendicular to the direction X and the direction Y.

The apparatus front cover 24 is located at a closed position when closed with respect to the apparatus body 2 as illustrated in FIG. 3 and is located at an open position when opened with respect to the apparatus body 2 as illustrated in FIG. 4. The apparatus front cover 24 has air intakes 24*a* formed on a side wall of the apparatus front cover 24 to intake fresh air. By opening the apparatus front cover 24 as illustrated in FIG. 4, the image forming part 3 and the waste toner collecting container 7 are exposed for replacement or maintenance support for each image forming unit 23, the intermediate transfer belt 13, and the waste toner collecting container 7.

As illustrated in FIG. 4, the branch duct 40 is fixed to the rear side of the apparatus front cover 24 with fixing members such as screws. The branch duct 40 has an air inlet port 41, first air outlet ports 42, and second air outlet ports 43 integrally. The air inlet port 41 is provided at the right end of the branch duct 40 in FIG. 4. The first air outlet ports 42 are provided corresponding to the image forming units 23Y, 23M, 23C, and 23K. The second air outlet ports 43 are also provided corresponding to the image forming units 23Y, 23M, 23C, and 23K.

The air inlet port 41 collects and intakes airflow forcedly supplied from an air supply fan 103 that functions as a ventilation unit disposed in the apparatus body 2.

Each first air outlet port 42 is inserted into a development side inlet port 26 provided on a unit front cover 25 of each image forming unit 23 when the apparatus front cover 24 is located at the closed position, so that the airflow received by the air inlet port 41 is branched to distribute to each image forming unit 23.

Each second air outlet port 43 is inserted into a charger side inlet 27 provided on the unit front cover 25 of each image forming unit 23 when the apparatus front cover 24 is located at the closed position, so that the airflow received by the air inlet port 41 is branched to distribute to each image forming unit 23.

Figure 5:
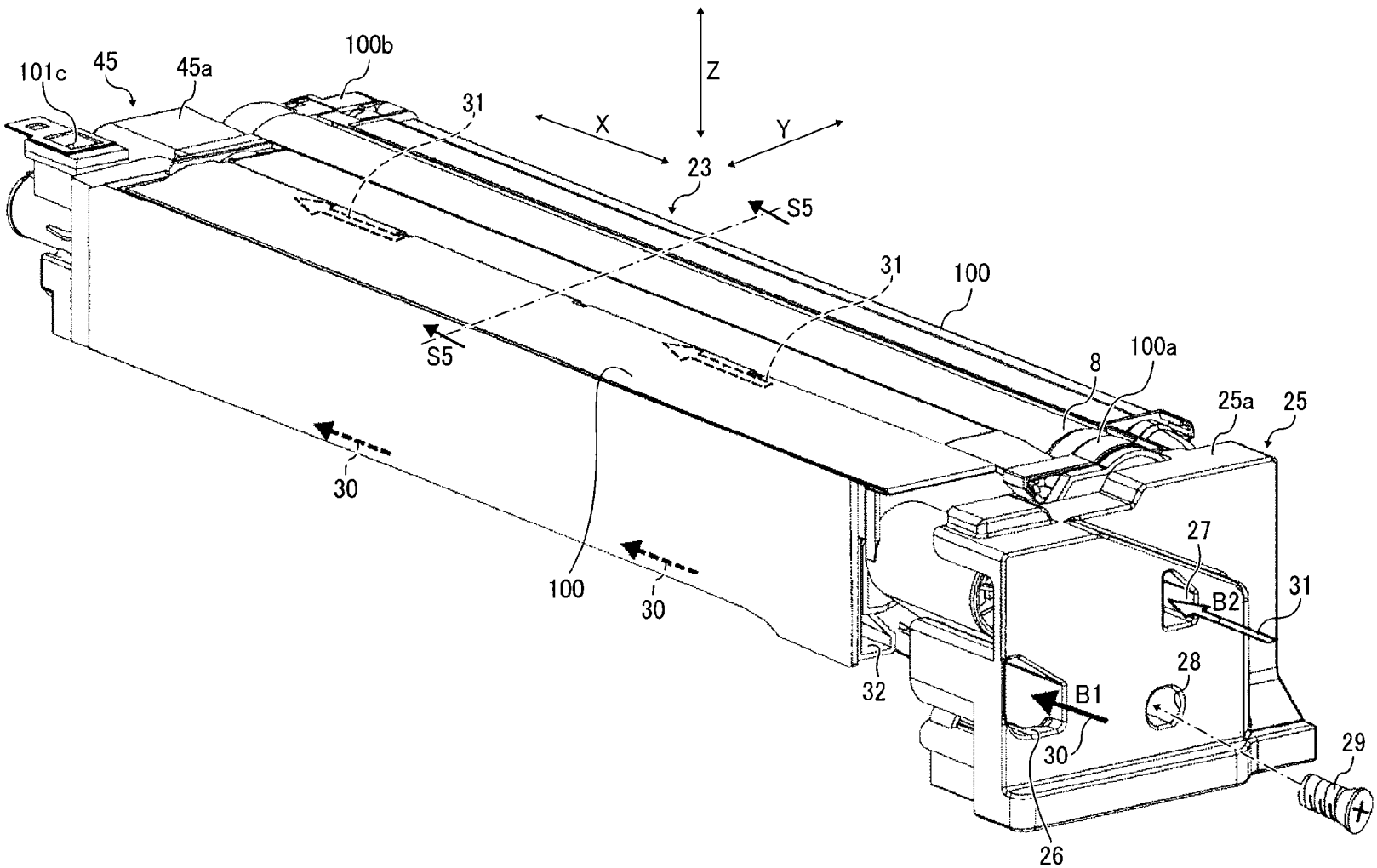
FIG. 5 is a perspective view illustrating the image forming unit, viewed from a front side thereof in a longitudinal direction thereof.
Figure 6A:
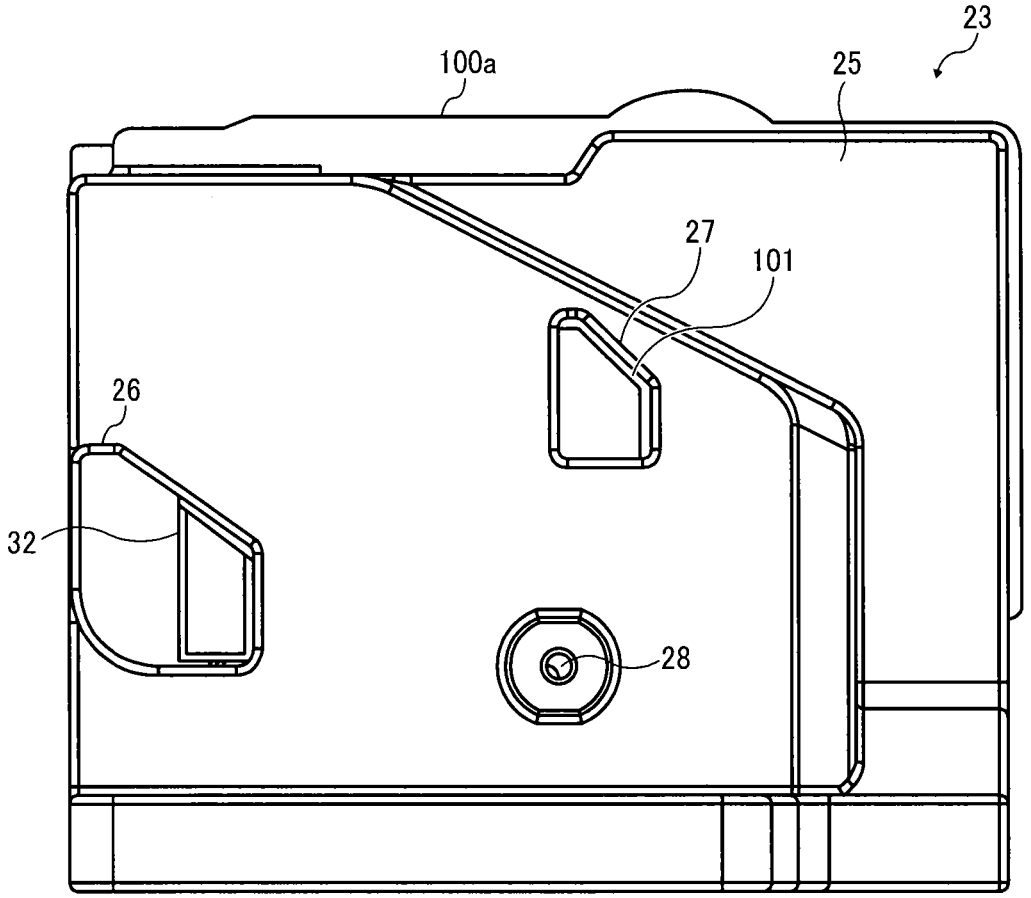
FIG. 6A is a front view illustrating a front side end of the image forming unit with the front cover attached thereto.
Figure 6B:
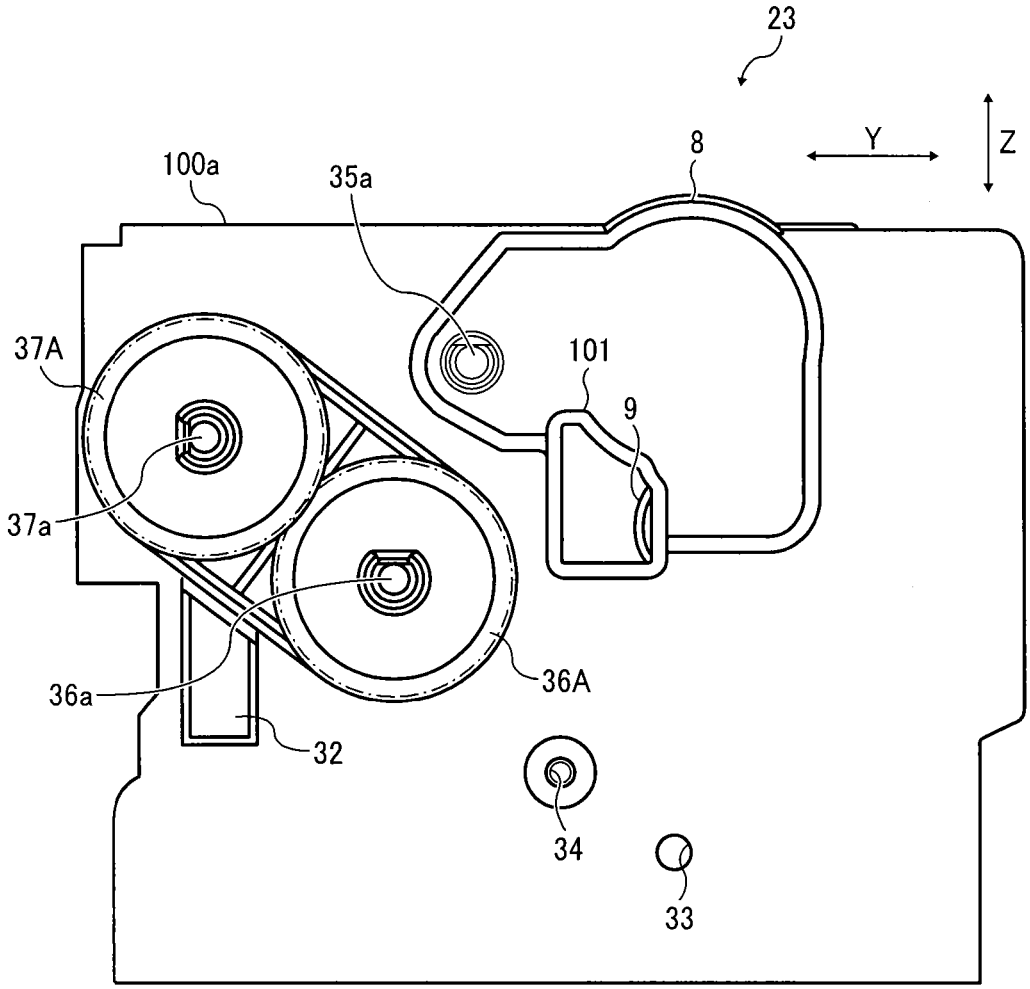
FIG. 6B is a front view with illustrating the front side end of the image forming unit with the front cover removed to show a unit drive mechanism and so forth.
Figure 7:
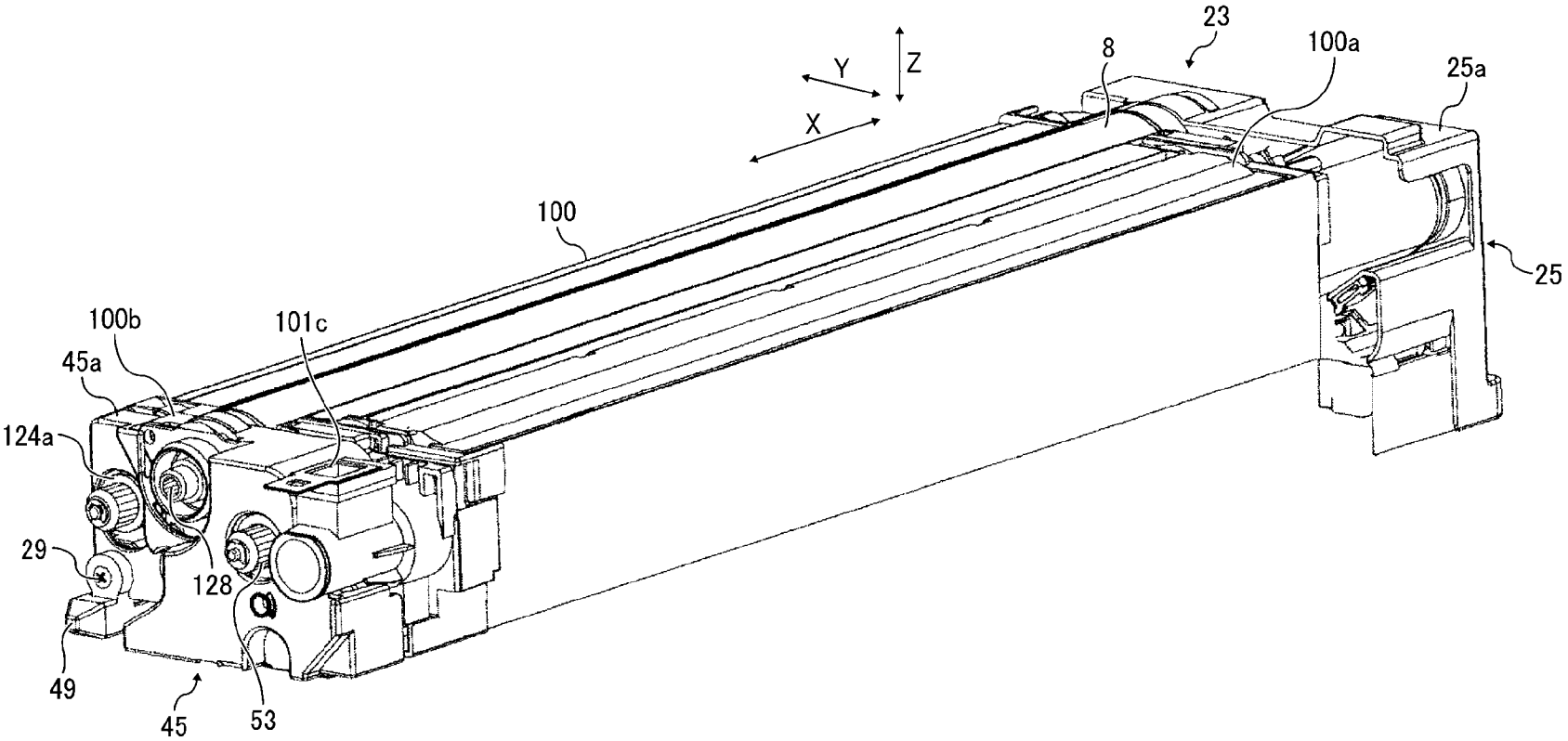
FIG. 7 is a perspective view illustrating the image forming unit, viewed from a rear side thereof in the longitudinal direction thereof.

With respect to FIGS. 5 through 7, a further detailed description is given of the configuration of the image forming unit 23.

FIG. 5 is a perspective view of the image forming unit 23, as viewed from an oblique front side thereof in the direction X. FIG. 6A is a front view of the image forming unit 23 with the unit front cover 25 attached to the unit front end 100*a*. FIG. 6B is a front view of the image forming unit 23 with the unit front cover 25 removed from the unit front end 100*a* and a drive mechanism and so forth of the unit front end 100*a* exposed. FIG. 7 is a perspective view of the image forming unit 23, as viewed from an oblique rear side thereof in the direction X.

As described above, the image forming unit 23 is detachably attachable with respect to the apparatus body 2 in the direction X that is a given direction of attaching and detaching the image forming unit 23 as illustrated in FIGS. 5 and 7. The image forming unit 23 includes at least a unit drive mechanism described below and the charging roller 9 illustrated in FIG. 2, both of which serves as heaters to be cooled.

As illustrated in FIGS. 5 and 7, the image forming unit 23 includes the unit front cover 25 and a unit rear cover 45 as an example of covers, each of which covers a drive mechanism (described below) of the image forming unit 23 and is disposed at one end and an opposed end of the unit body 100 in the front-to-back direction X thereof.

The unit front cover 25 that functions as a cover is detachably attached to the unit front end 100*a* that is disposed at the one end of the unit body 100 in the front-to-back direction X.

The unit front end 100*a* further includes a first agitation conveyance screw gear 36A and a second agitation conveyance screw gear 37A. The first agitation conveyance screw gear 36A is fixed to the front end of the shaft 36*a* of the first agitation conveyance screw 36. The second agitation conveyance screw gear 37A meshes with the first agitation conveyance screw gear 36A.

As described above, the first agitation conveyance screw gear 36A integrally rotates with the shaft 36*a*. The second agitation conveyance screw gear 37A is fixed to a front end of the shaft 37*a* of the second agitation conveyance screw 37 and integrally rotates with the shaft 37*a*.

The first agitation conveyance screw 36, the shaft 36*a*, the second agitation conveyance screw 37, the shaft 37*a*, the first agitation conveyance screw gear 36A, and the second agitation conveyance screw gear 37A function as a drive mechanism of rotary members and the unit front end 100*a*. A front end of the shaft 36*a* of the first agitation conveyance screw 36 and a front end of the shaft 37*a* of the second agitation conveyance screw 37 are exposed from the unit front end 100*a*. Further, the first agitation conveyance screw gear 36A and the second agitation conveyance screw gear 37A are exposed from the unit front end 100*a*. These rotary members including the front end of the shaft 36*a*, the front end of the shaft 37*a*, the first agitation conveyance screw gear 36A, and the second agitation conveyance screw gear 37A, which are exposed from the unit front end 100*a*, are covered at least by the unit front cover 25.

The unit rear end 100*b* that is disposed at the other end of the unit body 100 in the front-to-back direction X includes a unit rear cover 45 that functions as the other cover. The unit rear cover 45 is detachably attached to the unit body 100. Detail configurations of the unit rear end 100*b* and the unit rear cover 45 will be described below.

The unit body 100 further includes a toner supply port 101*c* to supply toner as developer to the development device 10 in the unit body 100.

Each of the unit front cover 25 and the unit rear cover 45 is formed by a suitable resin in an integral units (described below). By so doing, both the unit front cover 25 and the unit rear cover 45 contribute to a cost reduction. As illustrated in FIGS. 5 and 7, the unit front cover 25 and the unit rear cover 45 are detachably attached to the unit front end 100*a* and the unit rear end 100*b* of the unit body 100, respectively, via screws 29 functions as first fixing members.

A flange 25*a* is provided over a substantially entire outer circumference of the unit front cover 25. The flange 25*a* extends in the backward direction of the front-to-back direction X to cover the drive mechanism of the unit front end 100*a*. Even with a partial difference in length of the flange 25*a* of the unit front cover 25, the unit front cover 25 is latched with the outer circumference of the unit front end 100*a* and protrusions and recesses of each part of the unit body 100. As described above, the unit front cover 25 has a shape to substantially seal the unit front end 100*a* so as to reduce leakage of air supplied from the apparatus body 2 as illustrated in FIG. 4. In addition, by fastening one portion at the lower center part of the unit front cover 25, the unit front cover 25 can be fastened reliably without loosening and/or rattling.

The unit front cover 25 integrally includes the development side inlet port 26, the charger side inlet 27, and a screw attachment opening 28.

As illustrated in FIG. 4, the development side inlets 26 function as first inlet ports to intake air from the apparatus body 2 and to guide the air into the image forming unit 23. Each development side inlet port 26 defines an upstream side of a development side airflow path 30 indicated with airflow B1 in FIG. 4.

The charger side inlets 27 function as first inlet ports to intake air from the apparatus body 2 and to guide the air into the image forming unit 23. Each charger side inlets 27 defines an upstream side of a charger side airflow path 31 indicted with airflow B2 in FIG. 4.

As illustrated in FIG. 6, the screw attachment opening 28 is an opening through which the unit front cover 25 is fastened and fixed to a female screw hole 34 formed on the unit front end 100*a* with the screw 29.

The unit front end 100*a* of the image forming unit 23 is detachably attached with respect to an apparatus body front panel that is fixed to the front end of the apparatus body 2 in the front-to-back direction X as illustrated in FIGS. 1 and 4 with screws that serve as second fixing members. As illustrated in FIG. 6B, the unit front end 100*a* has a unit screw attachment opening 33 to fasten and fix the image forming unit 23 with the screws to the apparatus body front panel of the apparatus body 2.

As illustrated in FIGS. 5 and 6, a fastening position at which the unit front end 100*a* is fastened and fixed to the apparatus body 2 with a screw via a unit screw attachment opening 33 and a fastening position at which the unit front cover 25 is fastened and fixed to the unit front end 100*a* with the screw 29 are different. When the unit front end 100*a* of the image forming unit 23 is fixed to the apparatus body 2 with the screw and the unit front cover 25 is fixed to the unit front end 100*a* with the screw 29, the screw and the unit screw attachment opening 33 are hidden by the unit front cover 25.

As described above, the present embodiment has the configuration that the unit front cover 25 may need to be detached from the unit front end 100*a* of the image forming unit 23 before removing the image forming unit 23 from the apparatus body 2. The unit front cover 25 and the unit rear cover 45 are detachably attached to the unit front end 100*a* and the unit rear end 100*b* of the unit body 100, respectively, with the screw 29. With this configuration, the unit front cover 25 and the unit rear cover 45 can be reused at replacement of the image forming unit 23, thereby contributing to resource saving and reducing costs.

As illustrated in FIGS. 5 and 6, the image forming unit 23 further includes a development duct 32 functioning as a duct to define an airflow path between the unit front cover 25 and the unit rear cover 45. The development duct 32 extends in the front-to-back direction X of the image forming unit 23. A rear end of the development duct 32 in the front-to-back direction is connected to communicate with the post-development inlet port 46 of the unit rear cover 45 illustrated in FIG. 9. The development duct 32 is manufactured by resin molding (for example, injection molding) to secure a certain level of accuracy of form. It is not likely that the development duct 32 is manufactured in a closed cross-section shape (a non-isosceles trapezoid shape) as illustrated in FIGS. 5 and 6 due to difficult demolding, and therefore a single unit of the development duct 32 is manufactured with the upper part thereof in an open cross-section shape. When the single unit of the development duct 32 is attached to the unit body 100, the upper part of the development duct 32 is closed by using the shape of a part of the bottom wall of the unit body 100 to obtain the closed cross-section shape. The part of the bottom wall of the unit body 100 and the single unit of the development duct 32 are assembled and closely attached to each other by interposing a seal member such as sponge therebetween.

The method of manufacturing the development duct 32 is not limited to the above-described method. For example, the development duct 32 can be manufactured by producing an appropriate longitudinal part in the front-to-back direction X in divided sections and attaching and fitting the divided sections to each other. Further, if the accuracy of form does not matter when manufacturing the development duct 32, the development duct 32 can be manufactured in a closed cross-section shape by blow molding.

As illustrated in FIG. 5, to enhance performance of attachment of the unit front cover 25 to the unit front end 100*a*, the front end of the development duct 32 is provided with space with respect to the rear end of the development side inlet port 26 due to arrangement of airflow paths.

As illustrated in FIG. 6, the first agitation conveyance screw gear 36A and the second agitation conveyance screw gear 37A are arranged being shifted in a diagonally vertical direction. With this arrangement, the unit body 100 has a redundant space at the lower left part in FIG. 6. The development duct 32 is disposed in the redundant space of the unit body 100 and is attached and fixed to the unit body 100 with a fixing member such as screws.

As described above, according to the present embodiment, the development duct 32 that functions as a duct is disposed by using the excess space of the unit body 100 and contributes to a reduction in side of the image forming unit 23.

The front end of the shaft 36*a* of the first agitation conveyance screw 36 and the front end of the shaft 37*a* of the second agitation conveyance screw 37, both of which forming the drive mechanism and disposed between the unit front cover 25 and the unit front end 100*a* of the unit body 100, are exposed from the unit front end 100. The development side inlet port 26 and the development side airflow path 30 are provided in the unit front cover 25 so that air supplied from the apparatus body 2 hits these exposed shafts 36*a* and 37*a* more (when compared with the unit rear cover 45 that covers the drive mechanism of the unit rear end 100*b*). With this configuration, the front end of the shaft 36*a* of the first agitation conveyance screw 36 and the front end of the shaft 37*a* of the second agitation conveyance screw 37 can be cooled constantly by the air supplied from the apparatus body 2.

As illustrated in FIGS. 6A and 6B, the unit front end 100*a* that is disposed facing the rear end of the charger side inlet 27 of the unit front cover 25 has a charger duct 101. The charger duct 101 functions as a duct for the charger (i.e., the charging roller 9) to connect for communication with the rear end of the charger side inlet 27. The charger duct 101 does not have a length as the development duct 32 for connecting for communication with the unit rear cover 45 but has a relatively short length to guide airflow (wind) guided by the charger side inlet 27 to the front end of the charging roller 9 as illustrated in FIG. 2.

Figure 12:
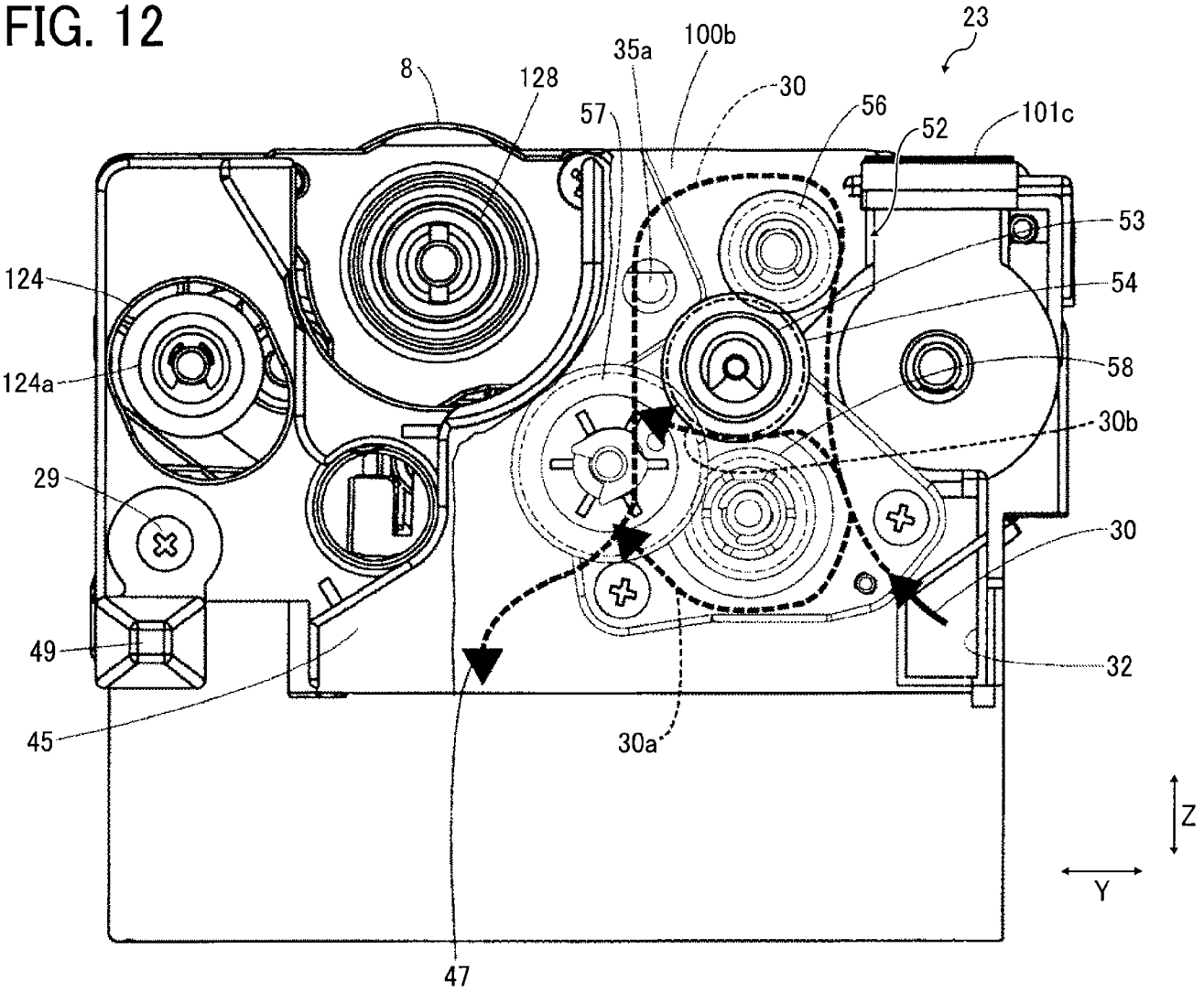
FIG. 12 is a rear view illustrating the airflow path adjacent to the development device on the rear side end of the image forming unit and the airflow.

As illustrated in FIG. 5, the air received from the charger side inlet 27 and passes through the charger duct 101 passes through the charger side airflow path 31 defined by an area or space adjacent to the charging roller 9 and the optical writing unit 4 of FIG. 2 and further moves in a backward direction of the front-to-back direction X. Then the air is collected in the unit rear cover 45 and is discharged to the post-development outlet port 47 as illustrated in FIGS. 9 and 12.

By cooling down the area adjacent to the charging device including the charging roller 9, changes of the electric resistance value of the charging roller 9 depending on temperature cannot hinder exhibiting the function of the charging roller 9 uniformly charging a target member, thereby preventing production of defect images.

As described above, the configuration of the present embodiment can cool down the area adjacent to the charging device including the charging roller 9. Therefore, by constantly maintaining the function that the charging roller 9 uniformly charges a target member, occurrence of defect images can be prevented.

Figure 8:
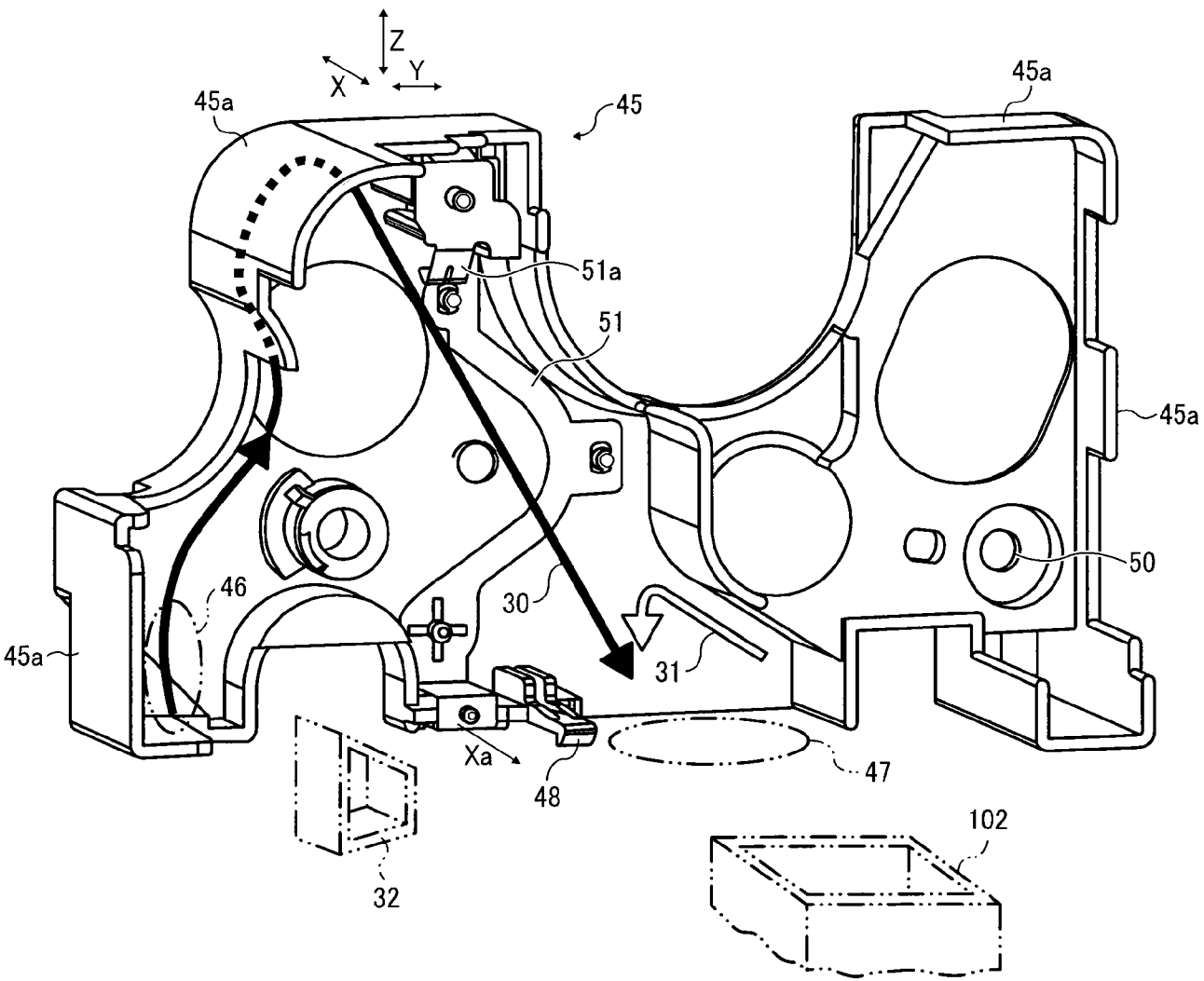
FIG. 8 is a perspective view illustrating a rear side of a rear cover and a downstream side of an airflow path adjacent to the development device.

With reference to FIGS. 7 through 9, a description is given of configurations and functions of the unit rear cover 45 and the unit rear end 100*b*.

Figure 9A:
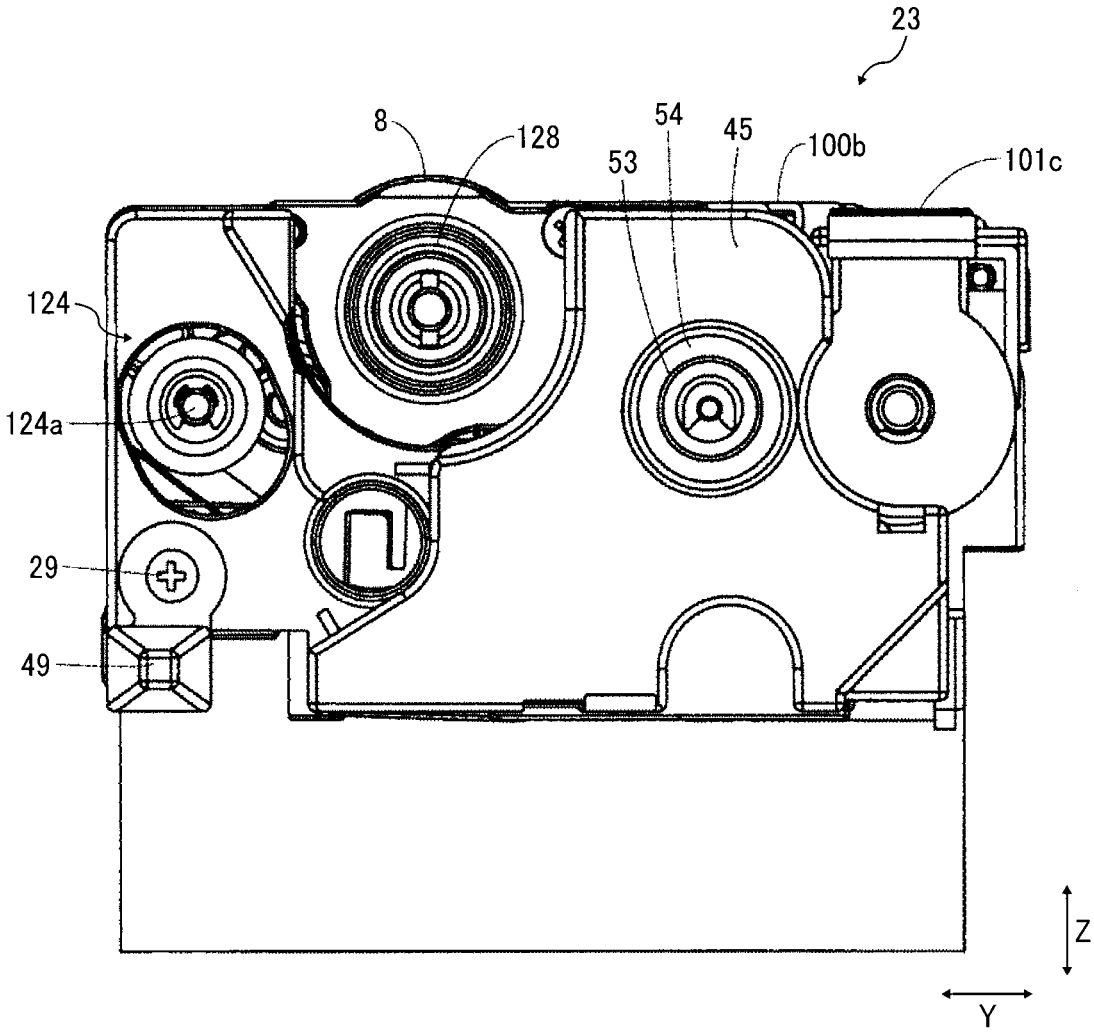
FIG. 9A is a rear view illustrating the rear cover attached to a rear side end of the image forming unit.
Figure 9B:
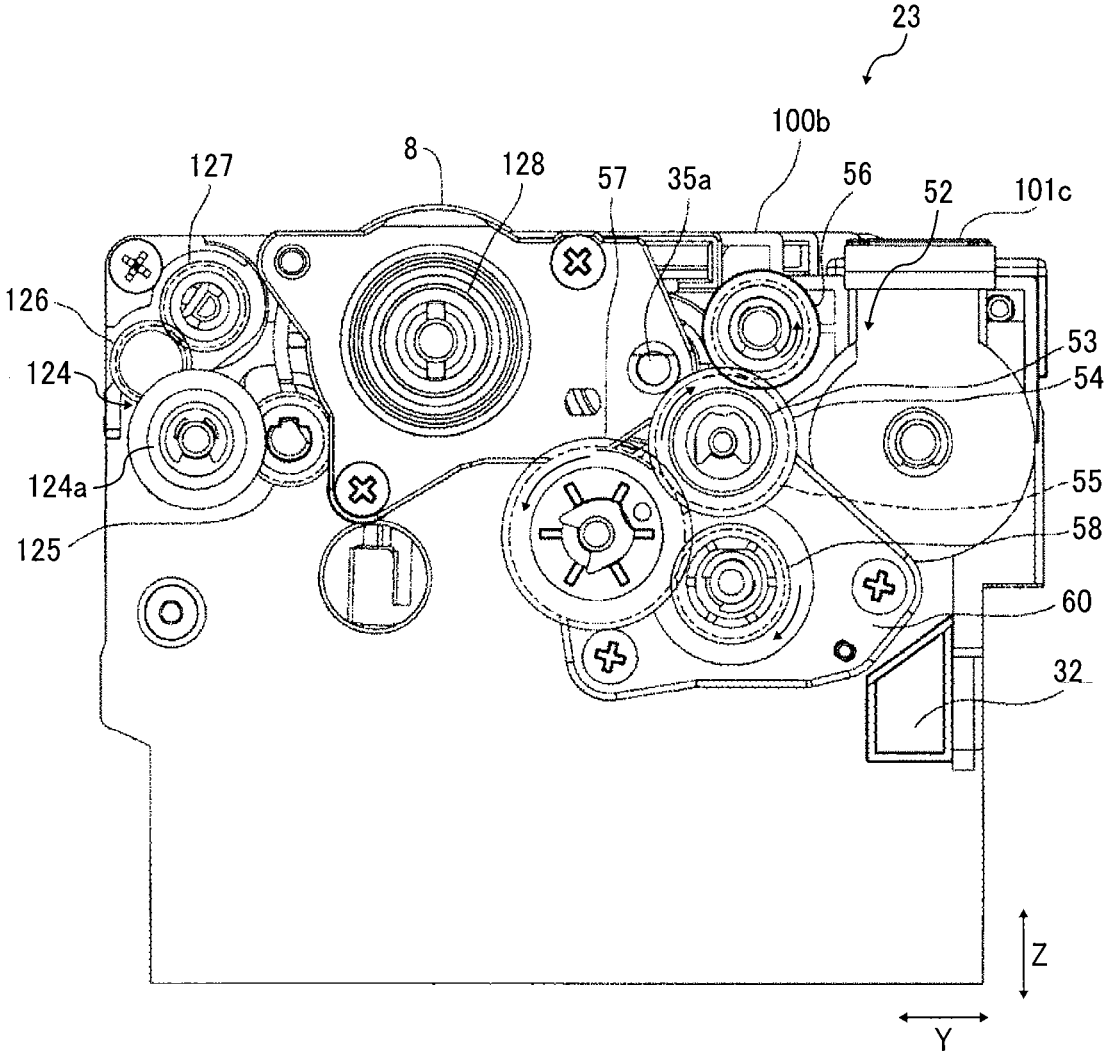
FIG. 9B is a rear view illustrating the rear side end of the image forming unit with the rear cover removed to show the unit drive mechanism and so forth provided to the rear side end of the image forming unit.

FIG. 8 is a perspective view illustrating a rear side of the unit rear cover 45 and a downstream side of the development side airflow path 30. FIG. 9A is a rear view illustrating the unit rear cover 45 that is attached to the unit rear end 100*b* of the image forming unit 23. FIG. 9B is a rear view illustrating the image forming unit 23 with the unit rear cover 45 removed to show a unit drive mechanism 52 provided to the unit rear end 100*b*.

The unit rear cover 45 has a flange 45*a* that extends in a forward direction Xa of the front-to-back direction X so as to cover the unit drive mechanism of the unit rear end 100*b*. The flange 45*a* is provided over a substantially entire outer circumference of the unit rear cover 45 to loosely attach to each part of the unit rear end 100*b*. Accordingly, the unit rear cover 45 substantially seals the unit rear end 100*b* so as to reduce an amount of leakage of air supplied from the development side inlet port 26 of the unit front cover 25 via the development duct 32.

As illustrated with two-dot chain lines in FIG. 8, the unit rear cover 45 integrally has the post-development inlet port 46 that functions as an inlet port to intake air from the image forming unit 23 and the post-development outlet port 47 that functions as an outlet port to discharge the air that has been taken from the post-development inlet port 46 and passed through the unit drive mechanism 52 to the apparatus body 2.

When the unit rear cover 45 is inserted and attached to the unit rear end 100*b* to the forward direction Xa of the front-to-back direction X, a rear end opening of the development duct 32 indicated with two-dot chain lines in FIG. 8 is connected with a gap to form respective paths for airflow to communicate with the post-development inlet port 46 of the unit rear cover 45. At the same time, a unit outlet port 102 (indicated with two-dot chain lines in FIG. 8) which is provided at a lower part of the unit rear end 100*b* is connected with a gap to form respective paths for airflow to communicate with the post-development outlet port 47 of the unit rear cover 45.

Here, the phrase "connected with a gap to communicate with" does not correspond to a state in which the rear end opening of the development duct 32 and the unit outlet port 102 are closely connected or sealed to the post-development inlet port 46 and the post-development outlet port 47, respectively, with no space but corresponds to a state in which the rear end opening of the development duct 32 and the unit outlet port 102 are connected with a gap or space to the post-development inlet port 46 and the post-development outlet port 47, respectively, to form respective airflow paths without impairing basic functions for communication.

The post-development inlet port 46 and the post-development outlet port 47 of the unit rear cover 45 are used to form the airflows indicated by arrows B1 and B2. With this configuration, a downstream side of the development side airflow path 30 is formed in the unit rear cover 45. When the unit rear cover 45 is attached to the unit rear end 100*b*, the development side airflow path 30 forms branch paths according to the position of the drive mechanism covered by the unit rear cover 45 as described below (refer to FIG. 12). Further, the airflow that is conveyed via the charger side airflow path 31 illustrated in FIG. 5 is collected to a rear side wall of the unit rear cover 45, forms the downstream side of the charger side airflow path 31, and is discharged to the post-development outlet port 47.

The post-development inlet port 46 and the post-development outlet port 47 of the unit rear cover 45 are used to form the airflows indicated by arrows B1 and B2. With this configuration, a downstream side of the development side airflow path 30 is formed in the unit rear cover 45.

Figure 10:
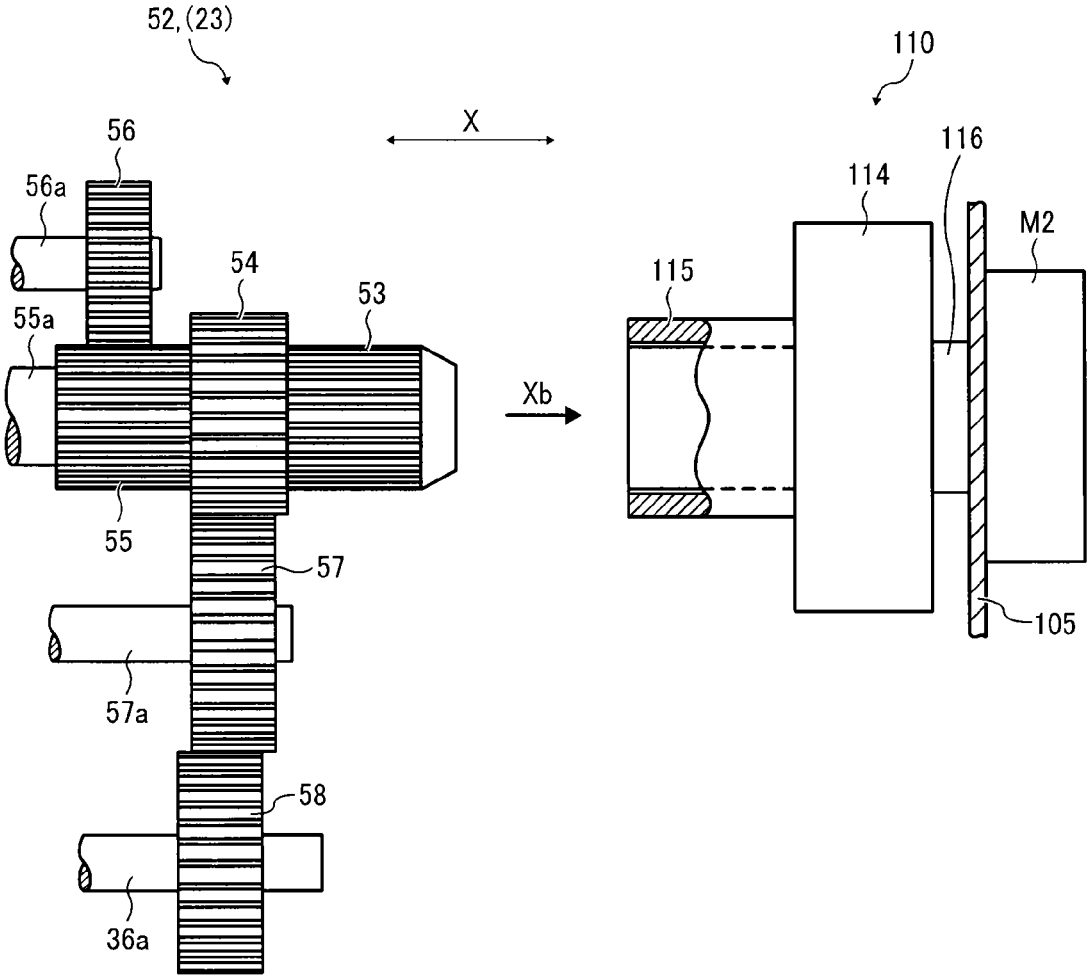
FIG. 10 is a plan view illustrating a development drive transmission mechanism and the unit drive mechanism.

Next, a description is given of a unit drive mechanism 52 that functions as a drive mechanism provided to the unit rear end 100*b*, with respect to FIGS. 9 through 11.

Figure 11A:
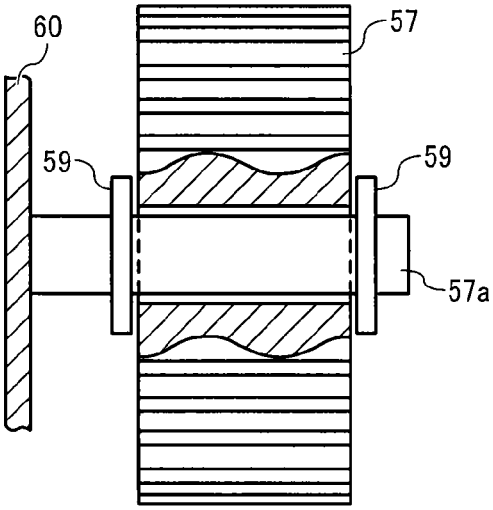
FIG. 11A is a partial cross-sectional plan view illustrating an assembly of a conveyance screw idler gear and a shaft thereof, both of which are included in the unit drive mechanism.
Figure 11B:
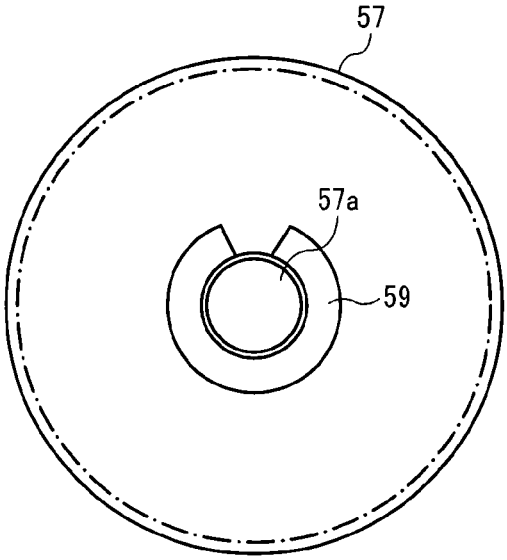
FIG. 11B is a front view of the assembly of the conveyance screw idler gear and the shaft of FIG. 11A.

FIG. 10 is a plan view illustrating a configuration of a development drive transmission mechanism 110 that functions as an apparatus body drive mechanism driving the development device 10 provided in the apparatus body 2 and a configuration of the unit drive mechanism 52. FIG. 11A is a partial cross-sectional plan view illustrating an assembly of a conveyance screw idler gear 57 and a shaft 57*a* of the conveyance screw idler gear 57. The conveyance screw idler gear 57 and the shaft 57*a* are included in the unit drive mechanism 52. FIG. 11B is a front view of the assembly of the conveyance screw idler gear 57 and the shaft 57*a*. To clarify a state of meshing of the gears, respective distances between pitches of the shafts are disregarded in FIG. 10.

As illustrated in FIG. 10, the development drive transmission mechanism 110 includes a development gear train 116 and a development joint member 114. The development gear train 116 includes multiple development gears to transmit a driving force from the development drive motor M2. The development joint member 114 is linked to an end gear of the development gear train 116 to transmit a driving force of the development gear train 116. The development joint member 114 includes a development joint gear that meshes with the eng gear of the development gear train 116 and a female joint 115. The development drive motor M2 is fixed to an apparatus body side plate 105 that is disposed on the rear side (the far side) of the apparatus body 2 in the front-to-back direction X as illustrated in FIG. 3.

In the present embodiment, the female joint 115 includes a development involute spline female part that has a high contact gear ratio among various spline joints. The present embodiment employs a spline joint that functions as a drive transmission member from the apparatus body 2 to the image forming unit 23 that serves as a process cartridge. The spline joint causes internal teeth formed on an inner circumferential surface of a cylindrical female part and external teeth formed an outer circumferential surface thereof to mesh with each other over the whole round. Consequently, the spline joint has a high contact gear ratio among various spline joints. Accordingly, by using the spline joint, gear meshing vibration or vibration caused at a joint part or joint parts due to meshing of gears can be prevented. Preferably, by employing an involute spline joint, the contact gear ratio can be increased, thereby further preventing the meshing vibration at the joint part(s). By so doing, speed variations of the development roller 35, the photoconductor 8, and the application roller 62 caused by the gear meshing vibration at the joint part(s) can be prevented.

In a case in which the above-described advantages and/of effects are not required, any known shaft couplings can be used instead of the spline joint.

As illustrated in FIGS. 9 and 10, the unit drive mechanism 52 includes a male joint 53, a drive gear 54, a small drive gear 55, a development idler gear 56, a conveyance screw idler gear 57, and a conveyance screw gear 58.

The male joint 53 functions as a first unit drive mechanism that links with the female joint 115 of the development drive transmission mechanism 110. The male joint 53 is formed of a suitable resin such as polyacetal resin and includes an involute spline male part.

By moving the image forming unit 23 in a backward direction Xb of the front-to-back direction X as illustrated in FIG. 10, the male joint 53 of the unit drive mechanism 52 is inserted into the female joint 115 of the development drive transmission mechanism 110, so that the development drive motor M2 can transmit a driving force.

The drive gear 54, the small drive gear 55, the development idler gear 56, the conveyance screw idler gear 57, and the conveyance screw gear 58 are formed by appropriate resins and function as a second unit drive mechanism. A shaft 55*a* of the small drive gear 55, a shaft 56*a* of the development idler gear 56, a shaft of 57*a* of the conveyance screw idler gear 57, and the shaft 36*a* of the conveyance screw gear 58 are formed by metal such as stainless steel.

It is to be noted that the shaft 36*a* of the conveyance screw gear 58 is the same as the shaft 36*a* of the first agitation conveyance screw 36 illustrated in FIG. 6. The above-described gears included in the second unit drive mechanism transmit the driving force to the male joint 53. With this configuration, the first agitation conveyance screw 36, the second agitation conveyance screw 37, and the development roller 35 functioning as rotary bodies in the image forming unit 23 are driven to rotate.

The drive gear 54 is integrally provided to the same shaft of the male joint 53. The small drive gear 55 is integrally provided to the same shaft of the male joint 53 and the drive gear 54. The small drive gear 55 rotates while slidingly contacting the shaft 55*a*. The development idler gear 56 is an idler intermediate gear that meshes with the small drive gear 55. The development idler gear 56 rotates while slidingly contacting the shaft 56*a* and meshes with a development roller gear provided on the development roller shaft 35*a*. The conveyance screw idler gear 57 meshes with the drive gear 54. The conveyance screw idler gear 57 rotates while slidingly contacting the shaft 57*a* as illustrated in FIG. 11. The conveyance screw gear 58 meshes with the conveyance screw idler gear 57. The conveyance screw gear 58 is integrally provided to the shaft 36*a* of the first agitation conveyance screw 36.

As illustrated in FIGS. 9B and 11, the shaft 57*a* of the conveyance screw idler gear 57 is attached and fixed to a frame 60 having a metallic thin shape provided to the unit rear end 100*b*. The shaft 57*a* has a retaining ring 59 attached at both ends thereof. The retaining rings 59 regulate movement of the conveyance screw idler gear 57 in the axial direction thereof. A given small gap is provided between a shaft hole of the conveyance screw idler gear 57 and an outer diameter of the shaft 57*a*.

The conveyance screw idler gear 57 that is made by resin rotates at a high speed while sliding around the metallic shaft 57*a*. By so doing, the metallic shaft 57*a* generates frictional heat. The frictional heat is transferred to the frame 60 and further to the conveyance screw gear 58 that is supported by the frame 60. Therefore, the frictional heat is transmitted to the shaft 36*a* of the first agitation conveyance screw 36 as illustrated in FIG. 6. With this frictional heat, the temperature of the first agitation conveyance screw 36 increases, and toner contained in the developer can melt or coagulate.

The shaft 55*a* of the small drive gear 55 attached and fixed to the frame 60 has the same structure as the shaft 57*a* of the conveyance screw idler gear 57, and therefore the metallic shaft 55*a* also generates frictional heat. Similarly, the frictional heat generated by the shaft 55*a* increases the temperature of the first agitation conveyance screw 36. Accordingly, it is likely to cause the toner to melt or coagulate.

As illustrated in FIGS. 7 and 9, the unit rear cover 45 has a shaped that covers the second unit drive mechanism provided to the unit rear end 100*b* and exposes the male joint 53 included in the first unit drive mechanism.

A description is given of the development side airflow path 30 on the unit rear end 100*b* to which the unit rear cover 45 is attached and airflow in the development side airflow path 30.

FIG. 12 is a rear view illustrating the development side airflow path 30 on the unit rear end 100*b* with the unit rear cover 45 and the airflow. A part of the unit rear cover 45 is omitted to show the parts and components accommodated therein.

As illustrated in FIG. 12, the unit rear cover 45 defines a downstream side of the development side airflow path 30 that serves as an airflow path along the drive gear 54, the small drive gear 55, the development idler gear 56, the conveyance screw idler gear 57, and the conveyance screw gear 58 of the second unit drive mechanism.

The airflow supplied from the development duct 32 that defines the upstream side of the development side airflow path 30 then flows through the downstream side of the development side airflow path 30 illustrated in FIG. 8 passing around the second unit drive mechanism as indicated by a broken line in FIG. 12. At the same time, the airflow supplied from the development duct 32 defines a first branch airflow path 30*a* by traveling below and adjacent to the conveyance screw gear 58 and the conveyance screw idler gear 57. Further, the airflow supplied from the development duct 32 defines a second branch airflow path 30*b* by traveling between the conveyance screw gear 58 and the conveyance screw idler gear 57 and between the drive gear 54 and the conveyance screw idler gear 57.

As previously described, the shaft 55*a* of the drive gear 54 and the small drive gear 55, the shaft 56*a* of the development idler gear 56, the shaft 57*a* of the conveyance screw idler gear 57, and the shaft 36*a* of the conveyance screw gear 58 are exposed between the unit rear cover 45 and the unit drive mechanism 52. Each of the shafts 55*a*, 56*a*, 57*a*, and 36*a* has the development side airflow path 30 including the first branch airflow path 30*a* and the second branch airflow path 30*b* as an airflow path so that air hit the shafts 55*a*, 56*a*, 57*a*, and 36*a*.

As described above, in the present embodiment, even if the second unit drive mechanism covered by the unit rear cover 45 is heated, the second unit drive mechanism is constantly cooled down by the airflow supplied from the development side airflow path 30. Therefore, melting and coagulation of toner contained in the developer can be prevented. In addition, the drive mechanisms of the unit front end 100*a* and the unit rear end 100*b* are cooled down efficiently without increasing the size of the image forming apparatus 1.

As illustrated in FIGS. 7 and 9A, the unit rear cover 45 includes a guide 49 to guide the image forming unit 23 when the image forming unit 23 is attached to the apparatus body 2 as illustrated in FIG. 4. The guide 49 has a leading edge that projects in the backward direction of the front-to-back direction X and is integrally formed with the unit rear cover 45. The leading edge of the guide is a tapered shape.

Figure 13A:
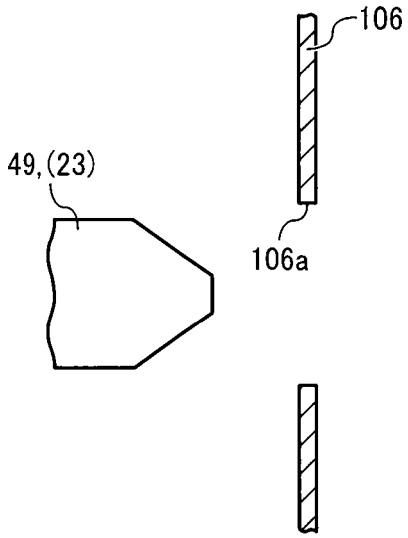
FIG. 13A is an enlarged cross-sectional diagram illustrating a state before a guide is inserted into a metal plate frame.

With reference to FIGS. 13A and 123B, a description is given of a positional relation of the guide 49 and the metal plate frame 106 and the function of the guide 49.

Figure 13B:
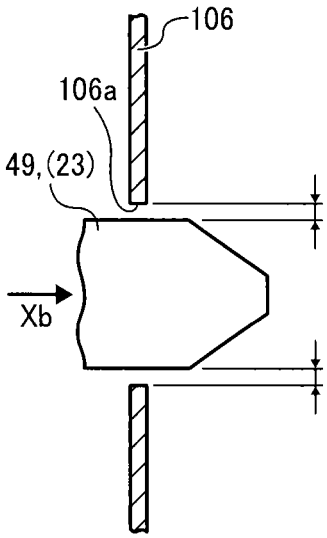
FIG. 13B is an enlarged cross-sectional diagram illustrating a state when the guide is inserted into the metal plate frame.

FIG. 13A is a cross sectional view illustrating a main part of the guide 49 and a metal plate frame 106 of the apparatus body side plate 105 of the apparatus body 2 before the guide 49 of the image forming unit 23 is inserted and attached to the metal plate frame 106 of the apparatus body side plate 105 of the apparatus body 2. FIG. 13B is a cross sectional view illustrating a main part after the guide 49 of the image forming unit 23 is attached to the metal plate frame 106 of the apparatus body side plate 105 of the apparatus body 2.

As illustrated in FIGS. 13A and 13B, the metal plate frame 106 is fixed to the apparatus body side plate 105 illustrated in FIG. 10 on the rear side of the apparatus body 2. FIG. 13A illustrates a state before the image forming unit 23 is attached to the apparatus body side plate 105 of the apparatus body 2 in the backward direction Xb of the front-to-back direction X. FIG. 13B illustrates a state after the image forming unit 23 has been attached to the apparatus body side plate 105. When the image forming unit 23 moves from the state of FIG. 13A to the state of FIG. 13B, the guide 49 is guided to a rough guide hole 106*a* formed on the metal plate frame 106 with a gap for rough locating. The relation of the guide 49 and the rough guide hole 106*a* of the metal plate frame 106 is not to position the image forming unit 23 but to enhance the attachment performance of the image forming unit 23.

According to the present embodiment, when the image forming unit 23 is attached to the apparatus body side plate 105, the guide 49 is roughly guided and located by the rough guide hole 106*a* of the metal plate frame 106. With this configuration, the operability in attachment of the image forming unit 23 to the apparatus body side plate 105 can be enhanced.

As illustrated in FIG. 8, the unit rear cover 45 includes a hook 48 that functions as an elastic attachment to elastically contact and engage the unit rear cover 45 with a part of the unit body 100 of the image forming unit 23. The hook 48 includes an elastic resin that bends elastically. A tip of the hook 48 projects forward in the front-to-back direction X. The hook 48 is integrally formed at the lower end on the rear side of the unit rear cover 45. The tip of the hook 48 has a hook-shaped protrusion and engages with a projection formed at the lower part of the unit rear end 100*b* of the unit body 100 by bending elastically.

When attaching and fixing the unit rear cover 45 to the unit rear end 100*b*, the tip of the hook 48 is engaged with the projection of the unit rear end 100*b*. Then, the screw 29 is inserted into a screw attaching hole 50 (FIG. 8) that serves as a fastening portion formed on the unit rear cover 45. By so doing, the unit rear cover 45 is fixed to the unit rear end 100*b*.

With the configuration according to the present embodiment, the hook 48 is elastically engaged with the projection formed on the unit rear end 100*b* and is fixed with the screw 29 through the screw attaching hole 50 formed on the unit rear cover 45. Accordingly, this configuration can fix the unit rear cover 45 to the unit rear end 100*b* reliably without loosening the unit rear cover 45.

On the rear side of the unit rear cover 45 in FIG. 8, the unit rear cover 45 is engaged using the hook 48 and fixed using the screw 29 at the lower right portion thereof. In addition, local loosening and rattling of the unit rear cover 45 can be prevented by latching and engaging a rather long part of the flange 45*a* on the left side of the unit rear cover 45 in FIG. 8 with an outer circumference or an appropriate part of the unit rear end 100*b*.

The rear side of the unit rear cover 45 corresponds to an inner side thereof and is disposed facing the unit rear end 100*b*. A thin copper plate 51 is disposed on the rear side of the unit rear cover 45. The copper plate 51 can be belt elastically and functions as a development bias transmitter that applies a development bias to the development roller 35 of FIG. 2. The copper plate 51 is attached and fixed to an appropriate portion on the rear side wall of the unit rear cover 45 by heat caulking. The lower end of the unit rear cover 45 is connected to a development bias applying part that is attached to the apparatus body 2. The copper plate 51 has a slope 51*a* that is elastically slanted.

Figure 14:
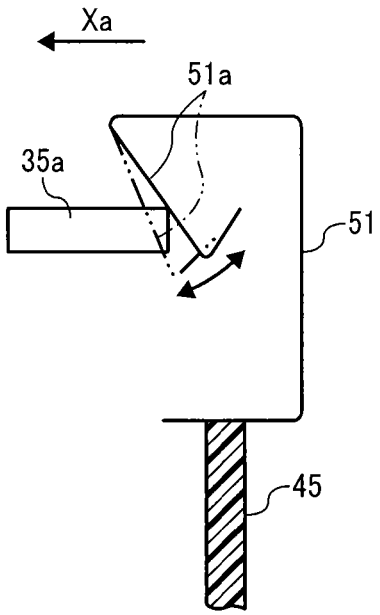
FIG. 14 is a cross-sectional diagram illustrating a state in which an one end of the development roller shaft contacts a slope of a copper plate for applying a development bias when the rear cover is attached to the rear side end of the image forming unit.

As illustrated in FIG. 14, when the unit rear cover 45 is attached to the unit rear end 100*b* in the forward direction Xa of the front-to-back direction X, one end of the development roller shaft 35*a* abuts against the slope 51*a* of the copper plate 51. By so doing, the one end of the development roller shaft 35*a* contacts the slope 51*a* of the copper plate 51 reliably in a state that the slope 51*a* of the copper plate 51 changes elastically from a position indicated by a two-dot chain line to a position indicted by a solid line.

With the above-described configuration and functions according to the present embodiment, when the unit rear cover 45 is attached to the unit rear end 100*b*, one end part of the development roller shaft 35*a* contact the slope 51*a* of the copper plate 51 reliably. Accordingly, the development bias can be applied to the development roller 35 reliably.

Figure 15:
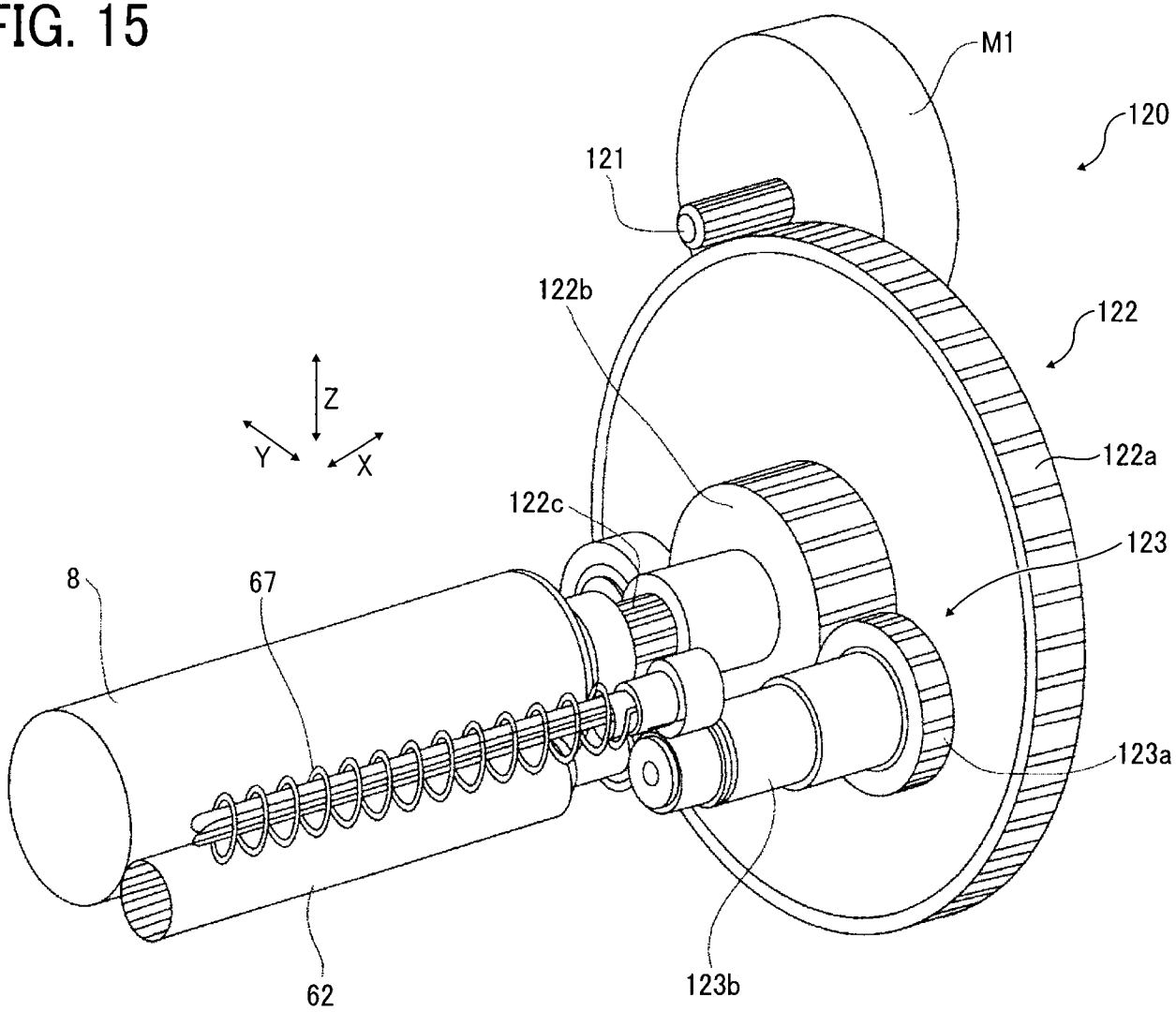
FIG. 15 is a perspective view illustrating a first drive transmission mechanism that transmits a driving force exerted by a photoconductor drive motor.
Figure 16:
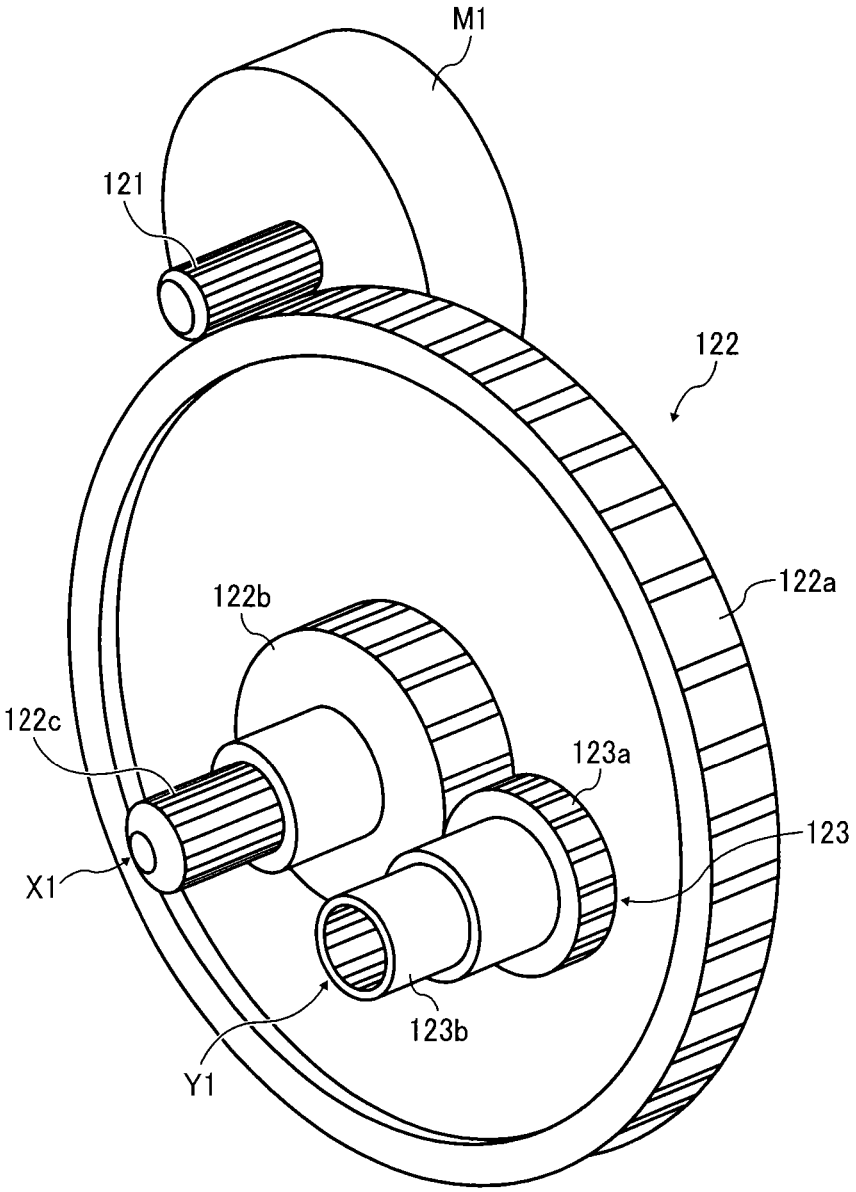
FIG. 16 is a perspective view illustrating a configuration of the first drive transmission mechanism on the apparatus body side.
Figure 17:
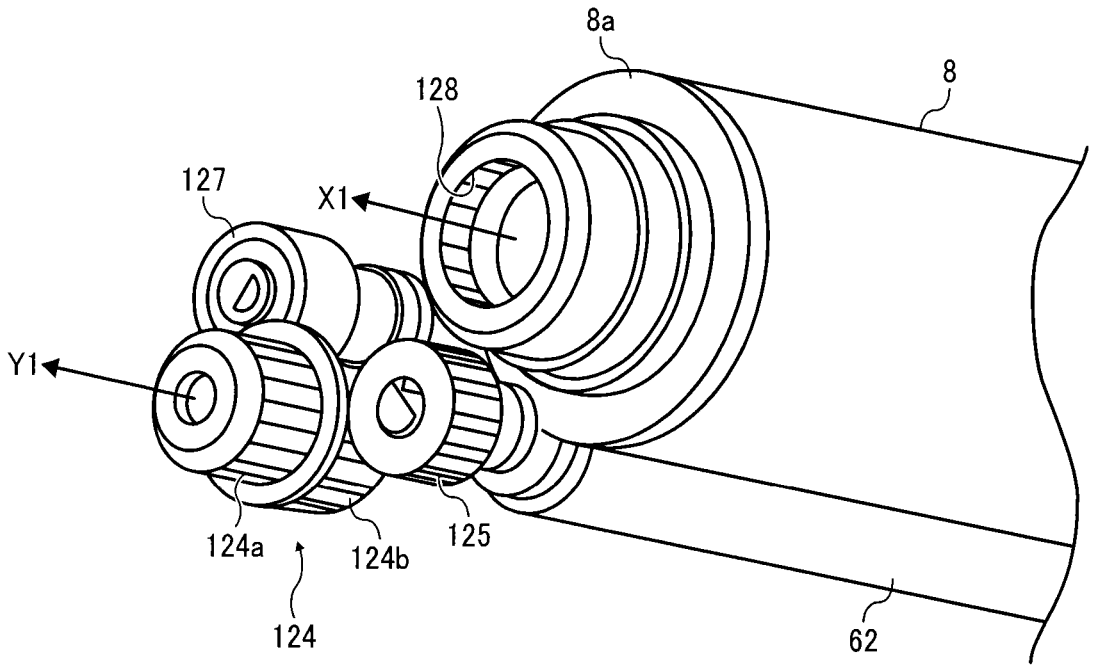
FIG. 17 is a perspective view illustrating a configuration of the first drive transmission mechanism on the image forming unit (the process cartridge) side.

Next, a description is given of a configuration of a first drive transmission mechanism 120 with reference to FIGS. 15 through 17.

The first drive transmission mechanism 120 transmits the driving force applied by the photoconductor drive motor M1 to the photoconductor 8, the conveyance screw 67, and the application roller 62 as illustrated in FIG. 2.

FIG. 15 is a perspective view illustrating the first drive transmission mechanism 120 transmitting the driving force of the photoconductor drive motor M1 to the photoconductor 8, the conveyance screw 67, and the application roller 62. FIG. 16 is a perspective view illustrating the first drive transmission mechanism 120 on the side of the apparatus body 2. FIG. 17 is a perspective view illustrating the first drive transmission mechanism 120 on the side of the image forming unit 23 (the process cartridge).

As illustrated in FIGS. 15 and 16, the first drive transmission mechanism 120 on the side of the apparatus body 2 includes a drive transmission member 122 and a cleaning female side joint member 123.

The drive transmission member 122 includes a photoconductor gear part 122*a*, a first gear part 122*b*, and a photoconductor involute spline male part 122*c*. The photoconductor gear part 122*a* meshes with a driving gear 121 of the photoconductor drive motor M1. The first gear part 122*b* transmits the driving force to the conveyance screw 67 and the application roller 62. The photoconductor involute spline male part 122*c* transmits the driving force to the photoconductor 8. The drive transmission member 122 is rotatably attached to the apparatus body side plate 105 illustrated in FIG. 10.

The cleaning female side joint member 123 includes a second gear part 123*a* and a cleaning involute spline female 123*b*. The second gear part 123*a* meshes with the first gear part 122*b*. As illustrated in FIG. 17, a photoconductor involute spline female part 128 that meshes with the photoconductor involute spline male part 122*c* of the drive transmission member 122 is provided to a rear side flange 8*a* of the photoconductor 8. The photoconductor involute spline male part 122*c* and the photoconductor involute spline female part 128 form a photoconductor involute spline joint.

As illustrated in FIG. 17, a cleaning male side joint member 124 and an idler gear 126 illustrated in FIG. 9 are rotatably attached to the unit rear end 100*b* of the image forming unit 23. The cleaning male side joint member 124 includes a cleaning involute spline male part 124*a* and a joint gear part 124*b*. The cleaning involute spline male part 124*a* meshes with the cleaning involute spline female 123*b*. The cleaning involute spline male part 124*a* and the cleaning involute spline female 123*b* form a cleaning involute spline joint. The joint gear part 124*b* meshes with a application roller gear 125 and an idler gear 126. The application roller gear 125 is fixed to the shaft of the application roller 62. The idler gear 126 meshes with a conveyance gear 127 that is fixed to the shaft of the conveyance screw 67.

As the image forming unit 23 is inserted into the apparatus body 2, the photoconductor involute spline female part 128 moves in a direction indicated by X1 in FIGS. 16 and 17. By so doing, the photoconductor involute spline male part 122*c* is inserted into the photoconductor involute spline female part 128. Consequently, the photoconductor involute spline male part 122*c* meshes with internal teeth of the photoconductor involute spline female part 128. Accordingly, the driving force applied by the photoconductor drive motor M1 is transmitted to the photoconductor 8 via the photoconductor gear part 122*a* and the photoconductor involute spline joint. As a result, the photoconductor 8 is driven to rotate.

Further, the cleaning involute spline male part 124*a* moves in a direction indicated by Y1 in FIGS. 16 and 17. By so doing, the cleaning involute spline male part 124*a* is inserted into the cleaning involute spline female 123*b*. Consequently, the cleaning involute spline male part 124*a* meshes with internal teeth of the cleaning involute spline female 123*b*. Accordingly, the driving force applied by the photoconductor drive motor M1 is transmitted to the application roller 62 via the photoconductor gear part 122*a*, the first gear part 122*b*, the second gear part 123*a*, the cleaning involute spline joint, the joint gear part 124*b*, and the application roller gear 125. As a result, the application roller 62 is driven to rotate. Further, the driving force applied by the photoconductor drive motor M1 is transmitted from the joint gear part 124*b* to the conveyance screw 67 via the idler gear 126 and the conveyance gear 127. As a result, the conveyance screw 67 is driven to rotate.

An additional description is give of how to position the image forming unit 23 with respect to the apparatus body 2, with reference to FIGS. 6, 7, 16, and 17.

The image forming unit 23 at the unit rear end 100*b* with respect to the apparatus body 2 in the left-to-right direction Y and the vertical direction Z is positioned by inserting and meshing the photoconductor involute spline female part 128 with the photoconductor involute spline male part 122*c*. The image forming unit 23 at the unit rear end 100*b* with respect to the apparatus body 2 in the front-to-back direction X, the left-to-right direction Y, and the vertical direction Z is positioned by attaching and fixing the unit front end 100*a* to the apparatus body front panel of the apparatus body 2 with a screw through the unit screw attachment opening 33 illustrated in FIG. 6.

Figure 18:
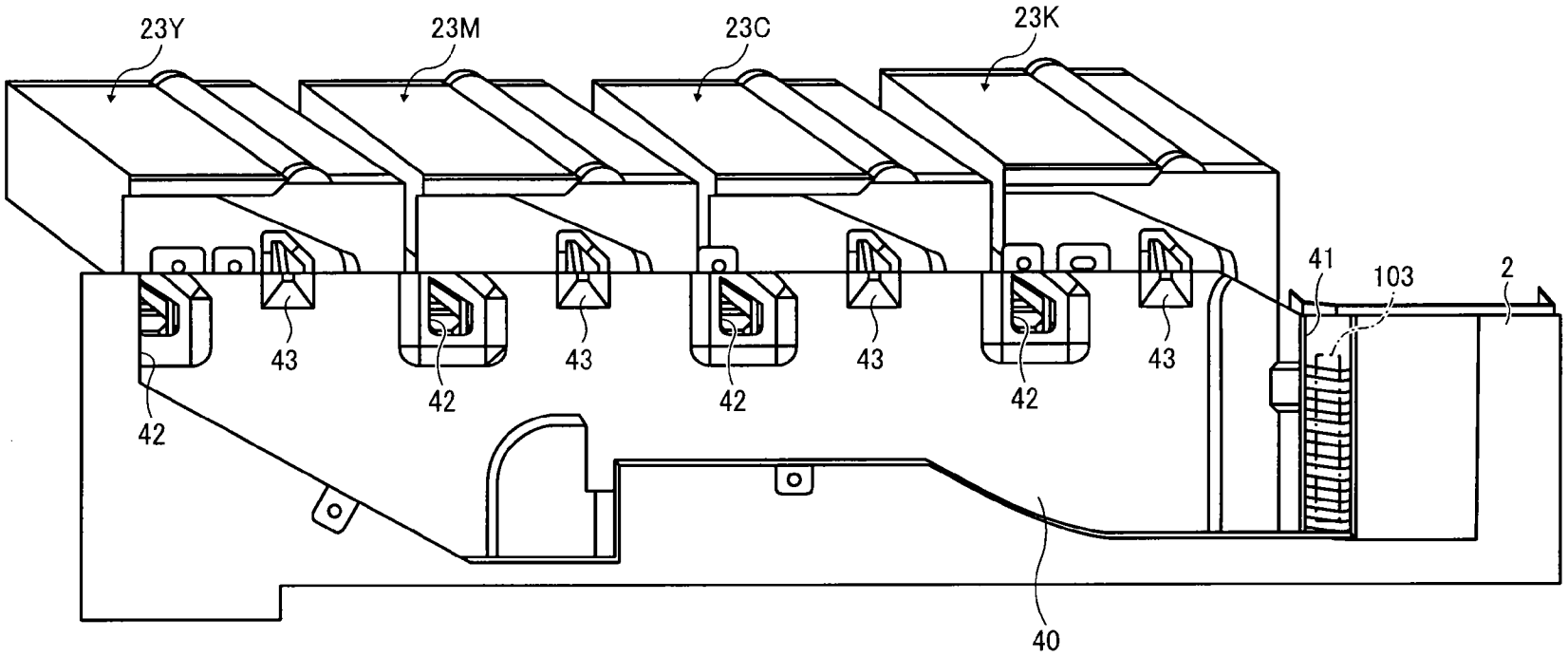
FIG. 18 is a perspective view illustrating a configuration of introducing air to each image forming unit.
Figure 19:
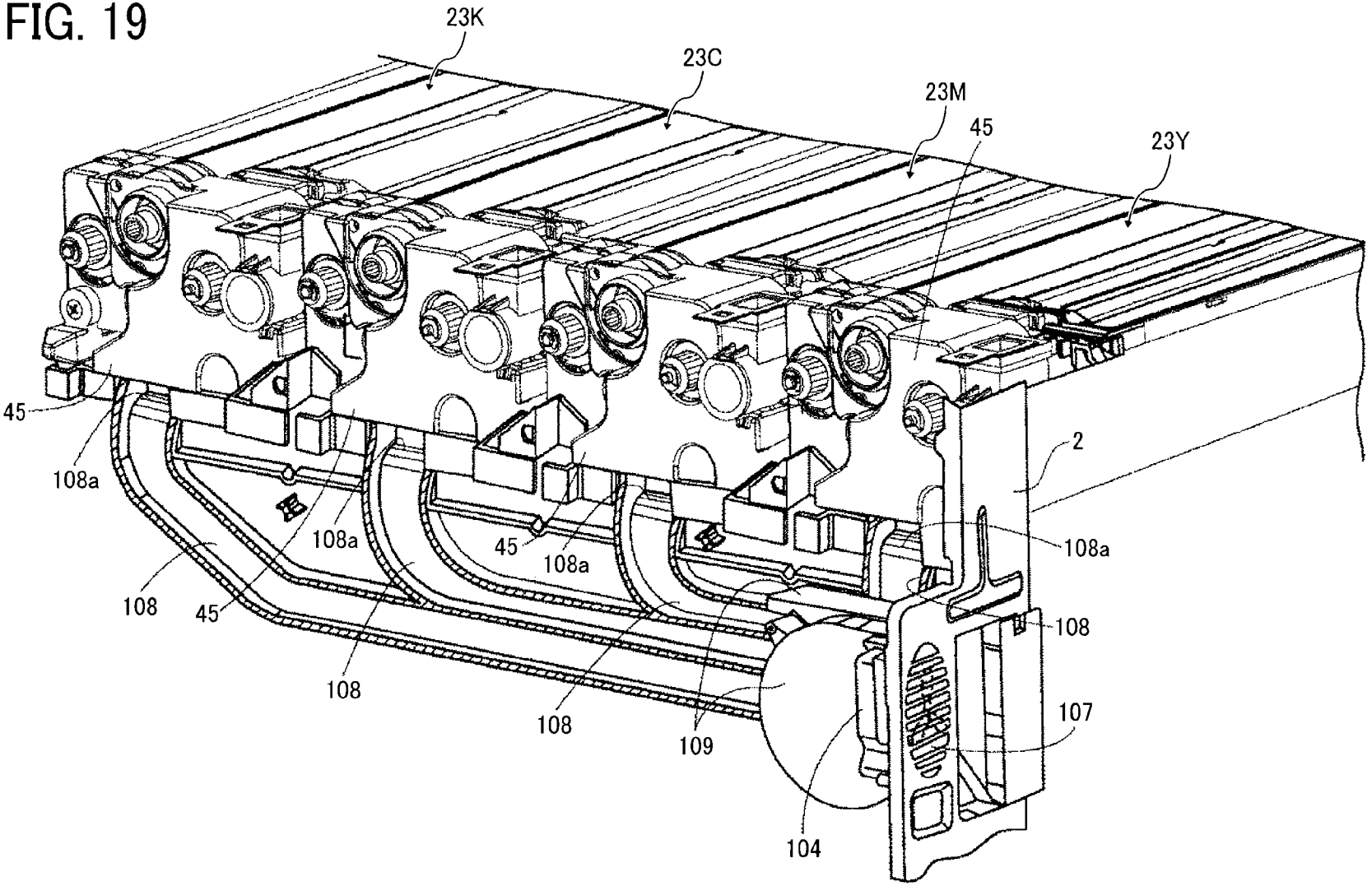
FIG. 19 is a partial cross-sectional view illustrating a configuration of discharging air from each image forming unit.

With reference to FIGS. 18 and 19, a description is given of a configuration of the image forming unit 23 on an air supplying side or a side where the air is supplied to be distributed therein and a configuration and operations of the image forming unit 23 on an air discharging side or a side from which the air distributed in the image forming unit 23 is discharged.

FIG. 18 is a perspective view illustrating a main part of the configuration of the air supplying side of the image forming unit 23. FIG. 19 is a partly cross-sectional perspective view illustrating a main part of the configuration of the air discharging side of the image forming unit 23.

FIG. 18 shows the air supplying side of the image forming unit 23 in a state in which each first air outlet port 42 and each second air outlet port 43 of the branch duct 40 are inserted into each development side inlet port 26 and each charger side inlet 27 of the unit front cover 25 of the image forming unit 23, respectively, with the apparatus front cover 24 closed. The air supplied by the air supply fan 103 provided to the apparatus body 2 is guided from the air inlet port 41 to a body of the branch duct 40. Then, the air is divided by each first air outlet port 42 and each second air outlet port 43 provided corresponding to each image forming unit 23 and distributed to the corresponding development side inlet port 26 and the corresponding charger side inlet 27, respectively, of the unit front cover 25 of each image forming unit 23.

As illustrated in FIG. 19, an air discharging fan 104 is provided to the rear side (the far side) of the apparatus body 2. The air discharging fan 104 functions as an air discharging unit to forcedly discharge air that passes through the post-development outlet port 47 of the image forming unit 23.

Exhaust ducts 108 are provided to the apparatus body 2 that disposed facing the lower part of the rear side (e.g., the unit rear end 100*b*) of the image forming unit 23. Each exhaust duct 108 that is illustrated in cross section is connected to the unit outlet port 102 illustrated in FIG. 8 to communicate therewith. Each exhaust duct 108 includes an exhaust port 108*a* that is connected to the unit outlet port 102 to communicate therewith. The exhaust ducts 108 are integrally formed by resin material and define air discharging paths to communicate with the unit outlet port 102.

At a downstream side of each exhaust duct 108, exhaust chambers 109 are disposed to collect the air discharged from the exhaust ducts 108. The air discharging fan 104 is disposed facing the exhaust chambers 109. An air exhaust louver 107 is disposed to the apparatus body 2 to which the air discharging fan 104 is attached. The air exhaust louver 107 discharges the air discharged form the image forming unit 23 by the air discharging fan 104 to the outside of the apparatus body 2.

In FIG. 19, due to the negative pressure and the suction force generated by rotating the air discharging fan 104, the air is sucked via the post-development outlet port 47 and the unit outlet port 102, both shown in FIG. 8, of the image forming unit 23. The air sucked from the image forming unit 23 flows through the exhaust ducts 108 to be collected in the exhaust chambers 109. Then, the air is discharged by the air discharging fan 104 from the air exhaust louver 107 to the outside the apparatus body 2.

Accordingly, with the above-described configurations and operations in the present embodiment, the image forming unit 23 including the male joint 53 and the unit drive mechanism 52 can be connected to the development drive transmission mechanism 110. At the same time, the unit drive mechanism 52 at the unit rear end 100*b* of the image forming unit 23 can be cooled down. In other words, the image forming unit 23 that can cool down the drive mechanisms on both sides thereof and the image forming apparatus 1 including the image forming unit 23 can be provided without increasing the size of the image forming apparatus 1. In addition, the unit front cover 25 and the unit rear cover 45 include the function to cool down the image forming unit 23 and the above-described functions as well as the function to cover the respective drive mechanisms.

The present embodiment is given to describe the image forming apparatus 1 that includes the air supply fan 103 serving as a ventilation unit but the present invention is not limited in scope thereto. For example, the image forming apparatus 1 can include a configuration without the air supply fan 103 by mounting an air discharging fan that is more powerful than the air discharging fan 104 on the apparatus body 2. Specifically, the image forming apparatus 1 has a configuration in which one of the covers has at least one first air inlet port that intakes air from the apparatus body 2 and guides the air to be distributed in a detachable unit.

The present embodiment is given to describe the image forming unit 23 serving as a process cartridge but the present invention is not limited in scope thereto. For example, a development unit 200 in which solely the development device 10 is integrally provided to the unit body 100 can be applied to the present invention. The development unit 200 can be detachably attached to the apparatus body 2 of the image forming apparatus 1. Different from the image forming unit 23, the development unit 200 omits the charger side inlet ports from the front cover so that solely the development side inlet ports are provided as first inlet ports. Further, a development unit 300 in which solely the development device 10 and the charging roller 9 serving as a charger are integrally provided to the unit body 100 can be applied to the present invention. The development unit 300 can be detachably attached to the apparatus body 2 of the image forming apparatus 1.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A detachable unit detachably attached to an image forming apparatus in a given attachment/detachment direction, the detachable unit comprising:

a unit body;

a unit drive mechanism to serve as a heater to be cooled; and a cover disposed at one end and an opposite end of the unit body in the given attachment/detachment direction to cover the unit drive mechanism, wherein the cover includes a first cover and a second cover, wherein the first cover includes at least one first inlet port to intake air from the apparatus body and guide the air to the unit body through at least one duct that defines an airflow path between the first cover and the second cover, wherein the second cover includes a second inlet port to intake the air guided into the unit body with a gap between the at least one duct and the second inlet port; and an air outlet port to exhaust the air introduced from the second inlet port to the apparatus body.

2. The detachable unit according to claim 1, further comprising a rotary shaft exposed between the first cover and the second cover, wherein the air flowing in the airflow path hits the rotary shaft.

3. The detachable unit according to claim 1, further comprising a rotary shaft having a first end and a second end and exposed between the first cover and the second cover; and multiple gears attached to the first end and the second end of the rotary shaft, wherein a first gear of the multiple gears is attached to the first end of the rotary shaft and a second gear of the multiple gears is attached to the second end of the rotary shaft, wherein the unit drive mechanism causes the first gear to rotate together with the first end of the rotary shaft at the one end of the unit body and the second gear to rotate while slidingly contacting the second end of the rotary shaft at the opposite end of the unit body, wherein the first cover including the at least one first inlet port covers the unit drive mechanism at the one end of the unit body.

4. The detachable unit according to claim 1, wherein the drive mechanism has a rotary body, wherein the unit drive mechanism further comprises a first unit drive mechanism disposed at the one end of the unit body in the given attachment/detachment direction and connected to an apparatus drive mechanism provided in the apparatus body; and a second unit drive mechanism disposed at the opposite end of the unit body in the given attachment/detachment direction to transmit a driving force to the first unit drive mechanism and drive the rotary body of the unit drive mechanism, wherein the cover defines an airflow path that extends through the second unit drive mechanism.

5. The detachable unit according to claim 1, wherein the detachable unit is a process cartridge integrally including an image carrier, a charger, and a development device, wherein the at least one first inlet includes multiple first inlet ports, wherein one of the first inlet ports of the first cover is used to cool down the development device including the unit drive mechanism and another one of the first inlet ports of the first cover is used to cool down the charger.

6. The detachable unit according to claim 1, wherein the detachable unit is a development unit including a development device to supply toner to an image formed on an image carrier.

7. An image forming apparatus comprising:

an apparatus body;

an image forming unit included in the apparatus body to form an image; and the detachable unit according to claim 1.

8. A detachable unit detachably attached to an image forming apparatus in a given attachment/detachment direction, the detachable unit comprising:

a unit body;

a unit drive mechanism to serve as a heater to be cooled; and a cover disposed at one end and an opposite end of the unit body in the given attachment/detachment direction to cover the unit drive mechanism, wherein the cover includes a first cover and a second cover, wherein the first cover includes at least one first inlet port to intake air from the apparatus body and guide the air to the unit body, wherein the second cover includes a second inlet port to intake the air guided into the unit body; and an air outlet port to exhaust the air introduced from the second inlet port to the apparatus body, wherein the first cover and the second cover are detachably attached to the unit body with a first fixing member, wherein the one end of the unit body is detachably attached to the apparatus body via a second fixing member, wherein the second fixing member is covered by the first cover when the one end of the unit body is fixed to the apparatus body with the second fixing member and the first cover is fixed to the unit body with the first fixing member in a state that a fixing position of the second fixing member to be fixed to the apparatus body on the one end of the unit body is different from a fixing position of the first fixing member to the unit body on the first cover.

9. An image forming apparatus comprising:

an apparatus body;

an image forming unit included in the apparatus body to form an image; and the detachable unit according to claim 8.

10. A detachable unit detachably attached to an image forming apparatus in a given attachment/detachment direction, the detachable unit comprising:

a unit body;

a unit drive mechanism included in the unit body to serve as a heater to be cooled and having a rotary body;

the unit drive mechanism comprising a first unit drive mechanism disposed at one end of the unit body in the given attachment/detachment direction and connected to an apparatus drive mechanism provided to the apparatus body, and a second unit drive mechanism disposed at the one end of the unit body in the given attachment/detachment direction to transmit a driving force to the first unit drive mechanism and to drive the rotary body of the unit drive mechanism; and a cover disposed at the one end of the unit body in the given attachment/detachment direction to cover the second unit drive mechanism while exposing the first unit drive mechanism, wherein the cover defines an airflow path that passes through the second unit drive mechanism, wherein the cover comprises an elastic attachment to contact a part of the unit body to be elastically attached to the unit body; and a fixing member to be attached and fixed to the one end of the unit body.

11. The detachable unit according to claim 10, wherein the cover comprises a guide to guide the unit body when the unit body is attached to the apparatus body.

12. The detachable unit according to claim 11, wherein the cover comprises an inlet port to intake the air guided into the unit body; and an outlet port to exhaust the air flowed through the second unit drive mechanism.

13. The detachable unit according to claim 12, wherein the cover is disposed at one end and an opposite end of the unit body in the given attachment/detachment direction to cover the unit drive mechanism, wherein the cover includes a first cover disposed at the one end of the unit body and a second cover disposed at the opposite end of the unit body, wherein the first cover includes at least one first inlet port to intake air from the apparatus body and to guide the air to the unit body, wherein the second cover includes a second inlet port to intake the air guided into the unit body; and an air outlet port to exhaust the air introduced from the second inlet port to the apparatus body.

14. An image forming apparatus according to claim 12, further comprising an air discharging unit in the apparatus body to exhaust the air flowed through the outlet port.

15. The detachable unit according to claim 11, wherein the detachable unit is a process cartridge integrally including an image carrier, a charger, and a development device, wherein the cover is detachably attached to the one end of the process cartridge via a fixing member, wherein the development device includes a rotary developer bearing member having a developer bearing member shaft to carry a developer to be supplied to the image carrier, wherein an elastic development bias transmitter is disposed inside the cover opposite to the one end of the process cartridge to apply a development bias to the developer bearing member, wherein, when the cover is attached to the one end of the process cartridge, one end of the developer bearing member shaft contacts the development bias transmitter.

16. The detachable unit according to claim 11, wherein the detachable unit is a development unit including a development device to supply toner to an image formed on an image carrier, wherein the cover is detachably attached to the one end of the development unit via a fixing member, wherein the development device includes a rotary developer bearing member having a developer bearing member shaft to carry a developer to be supplied to the image carrier, wherein an elastic development bias transmitter is disposed inside the cover opposite to the one end of the development unit to apply a development bias to the developer bearing member, wherein, when the cover is attached to the one end of the development unit, one end of the developer bearing member shaft contacts the development bias transmitter.

17. An image forming apparatus comprising:

an apparatus body;

an image forming unit included in the apparatus body to form an image; and the detachable unit according to claim 11.

* * * * *